US012102165B2

(12) United States Patent
Martin et al.

(10) Patent No.: US 12,102,165 B2
(45) Date of Patent: Oct. 1, 2024

(54) ADJUSTABLE SPORT HELMET

(71) Applicant: SPORT MASKA INC., Montreal (CA)

(72) Inventors: Philippe Martin, Chambly (CA); Brian Steenbrink, Pointe-Claire (CA); Simon-Pierre Germain, Granby (CA); Pierre-Luc Beauchamp, Montréal (CA); Bernard Daoust, Sutton (CA)

(73) Assignee: SPORT MASKA INC., St-Laurent (CA)

( * ) Notice: Subject to any disclaimer, the term of this patent is extended or adjusted under 35 U.S.C. 154(b) by 286 days.

(21) Appl. No.: 17/621,045

(22) PCT Filed: Jul. 3, 2020

(86) PCT No.: PCT/CA2020/050930
§ 371 (c)(1),
(2) Date: Dec. 20, 2021

(87) PCT Pub. No.: WO2021/000051
PCT Pub. Date: Jan. 7, 2021

(65) Prior Publication Data

US 2022/0338592 A1 Oct. 27, 2022

Related U.S. Application Data

(60) Provisional application No. 62/870,464, filed on Jul. 3, 2019.

(51) Int. Cl.
*A42B 3/32* (2006.01)

(52) U.S. Cl.
CPC ..... *A42B 3/324* (2013.01)

(58) Field of Classification Search
CPC ..... A42B 3/324; A42B 3/064; A42B 3/06
USPC ..... 2/425
See application file for complete search history.

(56) References Cited

U.S. PATENT DOCUMENTS 6,385,780 B1 * 5/2002 Racine ..... A42B 3/324 2/418
6,968,575 B2 * 11/2005 Durocher ..... A42B 3/12 2/418
2017/0079363 A1 * 3/2017 Durocher ..... A42B 3/324

FOREIGN PATENT DOCUMENTS

CA 2357690 3/2003
CA 2942637 3/2017

* cited by examiner

*Primary Examiner* — Timothy K Trieu
(74) *Attorney, Agent, or Firm* — NORTON ROSE FULBRIGHT CANADA

(57) ABSTRACT

A sport helmet has an outer shell including a first shell and a second shell movable relative to the first shell; levers hingedly connected to the first shell on left and right sides of the sport helmet for adjustably securing the first and second shells together; and finger-engageable locking actuators for selectively allowing movement of the levers from the engaged position to the disengaged position, the finger-engageable locking actuators being engaged to anchoring projections receivable within anchoring apertures, the finger-engageable locking actuators movable between a locked position and an unlocked position, wherein in the locked position movements of the levers relative to the first shell are limited via the anchoring projections, and wherein in the unlocked position the anchoring projections are disengaged from the anchoring apertures such that the levers are pivotable between the engaged position and the disengaged position.

27 Claims, 15 Drawing Sheets

ADJUSTABLE SPORT HELMET

CROSS-REFERENCE TO RELATED APPLICATIONS

This application claims priority from U.S. patent application 62/870,464 filed on Jul. 3, 2019. Its content is incorporated herewith in its entirety.

TECHNICAL FIELD

The present disclosure relates to sport equipment, and more particularly to protective helmets.

BACKGROUND

Protective helmets are used in different applications such as sports, firefighting, construction work, and the military. Some of these protective helmets are adjustable and allow the wearer to adjust the helmet size to fit a particular head. Adjustment mechanisms of existing adjustable helmets present either a risk of being accidentally actuated or being cumbersome to operate. In some cases, the wearer is required to remove the helmet to adjust the size and to try it to verify the adjustment. This process may take many tries until the best match is achieved.

SUMMARY

In a first aspect, there is provided an adjustable sport helmet for receiving a head of a wearer, the wearer's head having a top region, left and right side regions, a rear region and an occipital region, the helmet having a longitudinal axis, a transversal axis, a vertical axis and left and right sides, the helmet comprising: an inner padding comprising first and second padding portions for covering at least partially the wearer's head; an outer shell at least partially enclosing the inner padding and comprising a first shell and a second shell, wherein the second shell comprises left and right second side portions comprising left and right engaging parts, and wherein the first shell comprises left and right first side portions defining left and right housings and comprising left and right anchoring apertures; left and right manually operable levers, the left and right levers extending from left and right first ends to left and right second ends opposite to the left and second first ends, wherein the left and right first ends are pivotably mounted to the left and right first side portions of the first shell such that the left and right levers are each pivotable with respect to the first shell between first and second positions, and wherein the left and right levers define left and right recesses extending longitudinally from the left and right second ends and comprise left and right engaging parts; left and right locking actuators being at least partially mounted within the left and right recesses of the left and right levers and comprising left and right walls having left and right finger-engaging surfaces accessible by at least one finger of the wearer and left and right members extending from the left and right walls and having left and right anchoring projections extending upwardly or downwardly, each of the left and right locking actuators being movable between a locked position and an unlocked position; wherein, in the locked position, the left and right anchoring projections of the left and right locking actuators engage within the left and right anchoring apertures for preventing pivotable movement of the left and right levers with respect to the first shell; wherein, in the first position, the left and right levers are partially received within the left and right housings and the left and right levers are each generally parallel to the longitudinal axis and wherein the left and right engaging parts of the left and right lever engage the left and right engaging parts of the second shell for preventing movement of the first shell relative to second shell; wherein, in response to the at least one finger of the wearer acting on the left and right finger-engaging surfaces of the left and right locking actuators, the left and right locking actuators are moved from the locked position to the unlocked position wherein the left and right anchoring projections no longer engage within the left and right anchoring apertures for allowing pivotable movement of the left and right levers with respect to the first shell from the first position to the second position; and wherein, in the second position, the left and right engaging parts of the left and right lever no longer engage the left and right engaging parts of the second shell for allowing movement of the first shell relative to the second shell and for allowing the wearer to adjust a fit of the sport helmet over the wearer's head.

Still in accordance with the first aspect, the left and right first side portions of the first shell may comprise left and right first inner surfaces, wherein the left and right second side portions of the second shell comprise left and right outer surfaces, and wherein the left and right first inner surfaces of the first shell at least partially may overlap the left and right second outer surfaces of the second shell for defining respective inner and outer left and right sliding surfaces.

Still in accordance with the first aspect, the left and right second side portions of the second shell may comprise first and second left longitudinal slots and first and second right longitudinal slots and wherein the helmet comprises first and second left connectors may be slidably mounted in the first and second left longitudinal slots of the second shell and first and second right connectors slidably mounted in the first and second left longitudinal slots of the second shell.

Still in accordance with the first aspect, the inner and outer left and right sliding surfaces may be retained together by the respective first and second left and right connectors such that they fit together in an overlapping relationship wherein, in use, in the second position, when the first shell moves relative to the second shell, the first and second left connectors slide in the first and second left longitudinal slots and the first and second right connectors slide in the first and second left longitudinal slots.

Still in accordance with the first aspect, the left engaging part of the outer shell may comprise a left outer tooth, the right engaging part of the outer shell may comprise a right outer tooth, and the left and right first side portions of the first shell may comprise left and right openings adapted to receive the left and right outer teeth of the second shell.

Still in accordance with the first aspect, the left engaging part of the left lever may comprises a plurality of left inner teeth, the right engaging part of the right lever may comprise a plurality of right inner teeth, wherein in the first position, the left outer tooth of the second shell engages at least one tooth of the plurality of left inner teeth of the left lever and the right outer tooth of the second shell engages at least one tooth of the plurality of right inner teeth of the right lever, and wherein in the second position, the left outer tooth of the second shell no longer engages the at least one tooth of the plurality of left inner teeth of the left lever and the right outer tooth of the second shell no longer engages the at least one tooth of the plurality of right inner teeth of the right lever.

Still in accordance with the first aspect, in use, in the second position, when the first shell moves relative to the second shell, the left outer tooth of the second shell may move within the left opening of the first shell and the right outer tooth of the second shell may move within the right opening of the first shell.

Still in accordance with the first aspect, the left and right housings may be defined by left and right upper walls extending outwardly and longitudinally on the left and right first side portions, left and right lower walls extending outwardly and longitudinally on the left and right first side portions, and left and right side walls connected to the left and right upper and lower walls and extending longitudinally on the left and right first side portions and wherein the left and right openings may be in the left and right first side walls and wherein the left and right anchoring apertures may be in the left and right upper walls or in the left and right lower walls.

Still in accordance with the first aspect, the left and right anchoring apertures may be left and right upper anchoring apertures in the left and right upper walls and wherein the left and right lower walls may comprise left and right lower anchoring apertures.

Still in accordance with the first aspect, the left and right anchoring projections of the left and right locking actuators may be left and right upper anchoring projections and wherein the left and right locking actuators may comprise left and right lower anchoring projections.

Still in accordance with the first aspect, in the locked position, the left and right upper and lower anchoring projections of the left and right locking actuators may engage within the left and right upper and lower anchoring apertures of the first shell for preventing pivotable movement of the left and right levers with respect to the first shell and wherein, in response to the at least one finger of the wearer acting on the respective left and right finger-engaging surfaces of the left and right locking actuators, the left and right locking actuators may translate with respect to the respective left and right levers from the locked position to the unlocked position wherein the left and right anchoring upper and lower projections may no longer engage within the left and right upper and lower anchoring apertures for allowing pivotable movement of the left and right levers with respect to the first shell from the first position to the second position.

Still in accordance with the first aspect, the left and right recesses of the left and right levers may be defined by left and right top walls extending longitudinally from the left and right second ends, left and right bottom walls extending longitudinally from the left and right second ends, and left and right side walls connected to the left and right top and bottom walls and extending longitudinally from the left and right second ends.

Still in accordance with the first aspect, the left and right top walls and left and right bottom walls of the left and right levers may comprise left and right top passages and left and right bottom passages for receiving the left and right anchoring upper and lower projections of the left and right locking actuators.

In accordance with a second aspect, there is provided an adjustable sport helmet for receiving a head of a wearer, the wearer's head having a top region, left and right side regions, a rear region and an occipital region, the helmet having a longitudinal axis, a transversal axis, a vertical axis and left and right sides, the helmet comprising: an inner padding comprising first and second padding portions for covering at least partially the wearer's head; an outer shell at least partially enclosing the inner padding and comprising a first shell and a second shell; left and right manually operable levers, the left and right levers extending from left and right first ends to left and right second ends opposite to the left and second first ends, wherein the left and right first ends are pivotably mounted to the first shell such that the left and right levers are each pivotable with respect to the first shell between first and second positions; left and right locking actuators mounted to the left and right levers, the left and right locking actuators comprising left and right finger-engaging surfaces accessible by at least one finger of the wearer, each of the left and right locking actuators being movable between a locked position and an unlocked position; wherein, in the locked position, the left and right locking actuators prevent pivotable movement of the left and right levers with respect to the first shell; wherein, in the first position, the left and right levers prevent movement of the first shell relative to second shell; wherein, in response to the at least one finger of the wearer acting on the left and right finger-engaging surfaces of the left and right locking actuators, the left and right locking actuators are moved from the locked position to the unlocked position to allow pivotable movement of the left and right levers with respect to the first shell from the first position to the second position; and wherein, in the second position, the left and right lever allow movement of the first shell relative to the second shell and for allowing the wearer to adjust a fit of the sport helmet over the wearer's head.

Still in accordance with the second aspect, the left and right levers may define left and right recesses extending longitudinally from the left and right second ends, wherein the left and right locking actuators may be at least partially mounted within the left and right recesses of the left and right levers, wherein the left and right finger-engaging surfaces may be provided on left and right walls of the left and right locking actuators and wherein the left and right locking actuators may comprise left and right members extending from the left and right walls.

Still in accordance with the second aspect, in response to the at least one finger of the wearer acting on the respective left and right finger-engaging surfaces of the left and right locking actuators, the left and right locking actuators may translate with respect to the respective left and right levers from the locked position to the unlocked position.

Still in accordance with the second aspect, the left and right members of the left and right locking actuators may engage the first shell for preventing pivotable movement of the left and right levers with respect to the first shell.

Still in accordance with the second aspect, the second shell may comprise left and right second side portions comprising left and right engaging parts, wherein the left and right levers may comprise left and right engaging parts, wherein, in the first position, the left and right engaging parts of the left and right lever may engage the left and right engaging parts of the second shell for preventing movement of the first shell relative to second shell, and wherein, in the second position, the left and right engaging parts of the left and right lever may no longer engage the left and right engaging parts of the second shell for allowing movement of the first shell relative to the second shell and for allowing the wearer to adjust a fit of the sport helmet over the wearer's head.

Still in accordance with the second aspect, the first shell may comprise left and right first side portions defining left and right housings and may comprise left and right upper anchoring apertures and left and right lower anchoring apertures, wherein the left and right members of the left and right locking actuators may comprise left and right upper anchoring projections and left and right lower anchoring projections, and wherein, in the locked position, the left and right upper and lower anchoring projections of the left and right locking actuators may engage within the left and right upper and lower anchoring apertures for preventing pivotable movement of the left and right levers with respect to the first shell.

Still in accordance with the second aspect, in the first position, the left and right levers may be partially received within the left and right housings and the left and right levers may be each generally parallel to the longitudinal axis.

Still in accordance with the second aspect, the left engaging part of the outer shell may comprise a left outer tooth, the right engaging part of the outer shell may comprise a right outer tooth, and the left and right first side portions of the first shell may comprise left and right openings adapted to receive the left and right outer teeth of the second shell.

Still in accordance with the second aspect, the left and right first side portions of the first shell may comprise left and right first inner surfaces, wherein the left and right second side portions of the second shell may comprise left and right outer surfaces, and wherein the left and right first inner surfaces of the first shell at least may partially overlap the left and right second outer surfaces of the second shell for defining respective inner and outer left and right sliding surfaces.

Still in accordance with the second aspect, the left and right second side portions of the second shell may comprise first and second left longitudinal slots and first and second right longitudinal slots and wherein the helmet may comprise first and second left connectors slidably mounted in the first and second left longitudinal slots of the second shell and first and second right connectors slidably mounted in the first and second left longitudinal slots of the second shell.

Still in accordance with the second aspect, the inner and outer left and right sliding surfaces may be retained together by the respective first and second left and right connectors such that they may fit together in an overlapping relationship wherein, in use, in the second position, when the first shell moves relative to the second shell, the first and second left connectors may slide in the first and second left longitudinal slots and the first and second right connectors may slide in the first and second left longitudinal slots.

In accordance with a third aspect, here is provided an adjustable sport helmet for receiving a head of a wearer, the wearer's head having a top region, left and right side regions, a rear region and an occipital region, the helmet having a longitudinal axis, a transversal axis, a vertical axis and left and right sides, the helmet comprising: an inner padding comprising first and second padding portions for covering at least partially the wearer's head; an outer shell at least partially enclosing the inner padding and comprising a first shell and a second shell, wherein the first shell comprises left and right housings with left and right upper anchoring apertures and left and right lower anchoring apertures; left and right manually operable levers, the left and right levers extending from left and right first ends to left and right second ends opposite to the left and second first ends, wherein the left and right first ends are pivotably mounted to the first shell such that the left and right levers are each pivotable with respect to the first shell between first and second positions; left and right locking actuators mounted to the left and right levers and comprising left and right walls having left and right finger-engaging surfaces accessible by at least one finger of the wearer and left and right members extending from the left and right walls and having left and right upper anchoring projections and left and right lower anchoring projections, each of the left and right locking actuators being movable between a locked position and an unlocked position; wherein, in the locked position, the left and right upper and lower anchoring projections of the left and right locking actuators engage within the left and right upper and lower anchoring apertures for preventing pivotable movement of the left and right levers with respect to the first shell; wherein, in the first position, the left and right levers engage the second shell for preventing movement of the first shell relative to second shell; wherein, in response to the at least one finger of the wearer acting on the respective left and right finger-engaging surfaces of the left and right locking actuators, the left and right locking actuators translate with respect to the respective left and right levers from the locked position to the unlocked position wherein the left and right anchoring upper and lower projections no longer engage within the left and right upper and lower anchoring apertures for allowing pivotable movement of the left and right levers with respect to the first shell from the first position to the second position; and wherein, in the second position, the left and right lever no longer engage the second shell for allowing movement of the first shell relative to the second shell and for allowing the wearer to adjust a fit of the sport helmet over the wearer's head.

Still in accordance with the third aspect, the second shell may comprise left and right second side portions comprising left and right engaging parts, wherein the left and right levers may comprise left and right engaging parts, wherein, in the first position, the left and right engaging parts of the left and right lever may engage the left and right engaging parts of the second shell for preventing movement of the first shell relative to second shell, and wherein, in the second position, the left and right engaging parts of the left and right lever may no longer engage the left and right engaging parts of the second shell for allowing movement of the first shell relative to the second shell and for allowing the wearer to adjust a fit of the sport helmet over the wearer's head.

Still in accordance with the third aspect, the left engaging part of the outer shell may comprise a left outer tooth, the right engaging part of the outer shell may comprise a right outer tooth, and the left and right first side portions of the first shell may comprise left and right openings adapted to receive the left and right outer teeth of the second shell.

Still in accordance with the third aspect, the left and right first side portions of the first shell may comprise left and right first inner surfaces, wherein the left and right second side portions of the second shell may comprise left and right outer surfaces, and wherein the left and right first inner surfaces of the first shell at least partially may overlap the left and right second outer surfaces of the second shell for defining respective inner and outer left and right sliding surfaces.

Still in accordance with the third aspect, the left and right second side portions of the second shell may comprise first and second left longitudinal slots and first and second right longitudinal slots and wherein the helmet may comprise first and second left connectors slidably mounted in the first and second left longitudinal slots of the second shell and first and second right connectors slidably mounted in the first and second left longitudinal slots of the second shell.

Still in accordance with the third aspect, the inner and outer left and right sliding surfaces may be retained together by the respective first and second left and right connectors such that they fit together in an overlapping relationship wherein, in use, in the second position, when the first shell moves relative to the second shell, the first and second left connectors may slide in the first and second left longitudinal slots and the first and second right connectors may slide in the first and second left longitudinal slots.

In accordance with a fourth aspect, there is provided a sport helmet for receiving a head of a wearer, comprising: an outer shell including a first shell and a second shell movable relative to the first shell; levers hingedly connected to the first shell on left and right sides of the sport helmet for adjustably securing the first and second shells together, the levers of the first shell including first members engageable to second members of the second shell, the first and second members defining at least two attachment points each corresponding to a respective one of at least two sizes of the sport helmet, the levers pivotable between an engaged position and a disengaged position, wherein in the engaged position the first shell is secured to the second shell via cooperating engagement of the first members with the second members at a corresponding one of the at least two attachment points, and wherein in the disengaged position the first members are disengaged from the second members such that the first shell is slidably movable relative to the second shell to adjust a size of the sport helmet; and finger-engageable locking actuators for selectively allowing movement of the levers from the engaged position to the disengaged position, the finger-engageable locking actuators being engaged to anchoring projections receivable within anchoring apertures, the finger-engageable locking actuators movable between a locked position and an unlocked position, wherein in the locked position movements of the levers relative to the first shell are limited via the anchoring projections received within the anchoring apertures, and wherein in the unlocked position the anchoring projections are disengaged from the anchoring apertures such that the levers are pivotable between the engaged position and the disengaged position.

Still in accordance with the fourth aspect, for each of the left and right sides, the first shell may be attached to the second shell via at least two fasteners received through at least two apertures defined through the first shell and through at least two longitudinal slots defined through the second shell, the at least two fasteners slidable within the at least two longitudinal slots.

Still in accordance with the fourth aspect, the first shell may define left and right openings, the second members of the second shell extending through the left and right openings.

Still in accordance with the fourth aspect, the first members of the levers may be left and right sets of inner teeth protruding from lateral walls of the levers and oriented toward the first shell and wherein the second members may be left and right outer teeth each protruding away the second shell, teeth of the left and right sets of inner teeth engageable with the left and right outer teeth to limit movement of the first shell relative to the second shell.

Still in accordance with the fourth aspect, the left and right outer teeth may define cavities sized to removably receive therein left and right selected ones of the teeth of the left and right sets of inner teeth.

Still in accordance with the fourth aspect, each of the levers may be received within a respective one of recesses defined by the first shell on the left and right sides of the sport helmet, each of the recesses partially enclosed between upper and lower walls of the first shell, the levers having top and bottom walls facing the upper and lower walls of the first shell upon the levers in the engaged position.

Still in accordance with the fourth aspect, the anchoring projections may include, for each of the levers, at least one anchoring projection extending from one or both of the top and bottom walls of the levers and wherein the anchoring apertures include, for each of the two recesses, at least one anchoring aperture defined through one or both of the upper and lower walls of the first shell.

Still in accordance with the fourth aspect, for each of the levers, the at least one anchoring projection may include two anchoring projections each extending from a respective one of the top and bottom walls and receivable with a respective one of two anchoring apertures each defined through a respective one of the upper and lower walls of the first shell.

Still in accordance with the fourth aspect, the finger-engageable locking actuators may be partially received within the levers and movable with the levers between the engaged position and the disengaged position.

Still in accordance with the fourth aspect, each of the finger-engageable locking actuators may be secured to a respective one of the anchoring projections via a flexible arm, the levers defining notches, the flexible arms abuttable against the notches and bendable upon contact with the notches thereby moving the anchoring projections out of the anchoring apertures upon the finger-engageable locking actuators moved from their locked position to their unlocked position.

Still in accordance with the fourth aspect, each of the finger-engageable locking actuators may include two flexible arms each having a respective one of the anchoring projections at distal ends thereof.

Still in accordance with the fourth aspect, the finger-engageable locking actuators may be movable in a direction perpendicular to pivot axes of the levers.

Still in accordance with the fourth aspect, the first shell may be a front shell and the second shell may be a rear shell of the sport helmet.

In accordance with a fifth aspect, there is provided a sport helmet for receiving a head of a wearer, comprising: an outer shell including a first shell and a second shell movable relative to one another, the second shell defining slots including first and second slots on a left side of the sport helmet and third and fourth slots on a right side of the sport helmet, the first shell defining apertures including first and second apertures on the left side and aligned respectively with the first and second slots, the first shell further defining third and fourth apertures on the right side and aligned respectively with the third and fourth slots; fasteners received through the apertures and slidably received within the slots, the first shell movable relative to the second shell by a sliding motion of the fasteners within the slots; and an adjustment mechanism operable to select a size of the sport helmet by allowing relative movements between the first shell and the second shell and to maintain a relative position of the first shell relative to the second shell.

Still in accordance with the fifth aspect, the slots may extend along a longitudinal axis defined from a front to a rear of the sport helmet, the first and second slots being vertically offset from one another about a vertical axis extending from a bottom to a top of the sport helmet and normal to the longitudinal axis, the third and fourth slots being vertically offset from one another.

Still in accordance with the fifth aspect, the first and second slots may be longitudinally offset from one another about the longitudinal axis, the third and fourth slots being longitudinally offset from one another.

Still in accordance with the fifth aspect, the adjustment mechanism may include levers hingedly connected to the first shell, the levers defining first members engageable to second members defined by the second shell, the second members located between the first and second slots and between the third and fourth slots.

Still in accordance with the fifth aspect, the levers may cover the slots and the apertures.

Still in accordance with the fifth aspect, the first and third slots may be located closer to the front of the sport helmet than the second and fourth slots, the first and third slots located closer to the top of the sport helmet than the second and fourth slots.

Still in accordance with the fifth aspect, the slots may be curved.

Still in accordance with the fifth aspect, the apertures of the first shell may be defined through two side portions protruding from a remainder of the first shell, the two side portions at least partially overlapping the second shell.

Still in accordance with the fifth aspect, the first shell may be a front shell and the second shell is a rear shell.

In accordance with a sixth aspect, there is provided a sport helmet for receiving a head of a wearer, comprising: an outer shell including a first shell and a second shell movable relative to one another to adjust a size of the sport helmet, the first shell including two side portions protruding away from a remainder of the first shell, the two side portions at least partially overlapping the second shell and ending at distal ends, the two side portions defining recesses each including an upper wall, a lower wall, and a side wall extending from the upper wall to the lower wall; an adjustment mechanism operable to select a size of the sport helmet, the adjustment mechanism including levers on left and right sides of the sport helmet and receivable within the recesses, the levers hingedly connected to the first shell via hinges located opposite the distal ends of the two side portions, each of the levers having a top wall, a bottom wall, and a lateral wall extending from the top wall to the bottom wall, the levers pivotable from an engaged position in which the first shell is secured to the second shell and in which the top walls and the bottom walls at least partially overlap the upper walls and the lower walls of the recesses and a disengaged position in which the first shell is slidably movable relative to the second shell to adjust the size of the sport helmet; and finger-engageable locking actuators located between the top walls and the bottom walls of the levers and proximate the distal ends of the side portions, the finger-engageable locking actuators operable to selectively allow movements of the levers from the engaged position to the disengaged position.

Still in accordance with the sixth aspect, the recesses may be open at the distal end of the side portions of the first shell.

Still in accordance with the sixth aspect, the finger-engageable locking actuators may be attached to the levers and slidably movable within lever recesses of the levers.

Still in accordance with the sixth aspect, for each of the left and right sides, the first shell may be attached to the second shell via at least two fasteners received through at least two apertures defined through the first shell and through at least two slots defined through the second shell, the at least two fasteners slidable within the at least two slots.

Still in accordance with the sixth aspect, the levers may define first members engageable to second members defined by the second shell.

Still in accordance with the sixth aspect, the first members of the levers may be left and right sets of inner teeth and oriented toward the first shell and wherein the second members are left and right outer teeth each protruding away the second shell, teeth of the left and right sets of inner teeth engageable with the left and right outer teeth.

Still in accordance with the sixth aspect, the left and right outer teeth may define cavities sized to removably receive left and right selected ones of the teeth of the left and right sets of inner teeth.

Still in accordance with the sixth aspect, the finger-engageable locking actuators may be engaged to anchoring projections received within anchoring apertures, the finger-engageable locking actuators movable from a locked position in which movements of the levers are limited via the anchoring projections received within the anchoring apertures to an unlocked position in which the anchoring projections are disengaged from the anchoring apertures and in which the levers are pivotable from the engaged position to the disengaged position.

Still in accordance with the sixth aspect, the anchoring projections may include, for each of the levers, at least one anchoring projection extending from one or both of the top and bottom walls of the levers and wherein the anchoring apertures include, for each of the two recesses, at least one anchoring aperture defined through one or both of the upper and lower walls of the first shell.

Still in accordance with the sixth aspect, for each of the levers, the at least one anchoring projection may include two anchoring projections each extending from a respective one of the top and bottom walls and receivable with a respective one of two anchoring apertures each defined through a respective one of the upper and lower walls of the first shell.

Still in accordance with the sixth aspect, each of the finger-engageable locking actuators may be secured to a respective one of the anchoring projections via a flexible arm, the levers defining notches, the flexible arms abuttable against the notches and bendable upon contact with the notches thereby moving the anchoring projections out of the anchoring apertures upon the finger-engageable locking actuators moved from the locked position to the unlocked position.

Still in accordance with the sixth aspect, each of the finger-engageable locking actuators may include two flexible arms each having a respective one of the anchoring projections at distal ends thereof.

Still in accordance with the sixth aspect, the finger-engageable locking actuators may be movable in a direction perpendicular to pivot axes of the levers.

Still in accordance with the sixth aspect, the first shell may be a front shell and the second shell may be a rear shell of the sport helmet.

DETAILED DESCRIPTION

Figure 1:
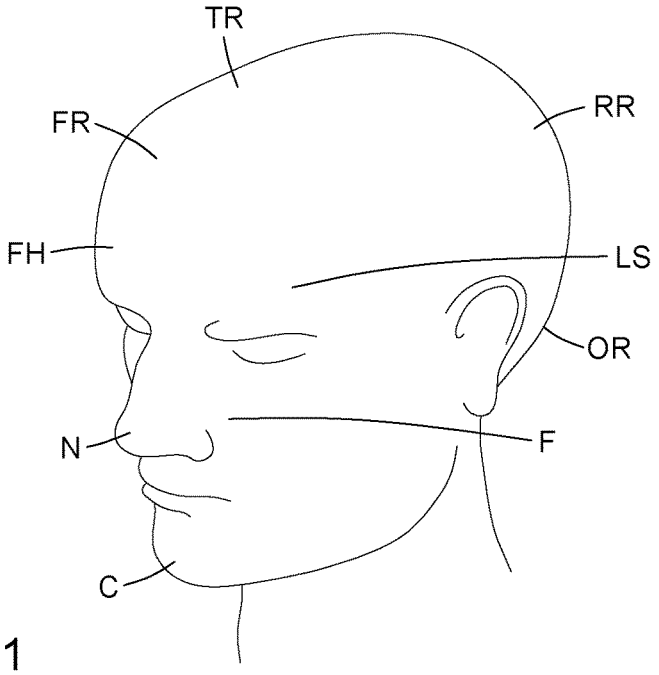
FIG. 1 is a schematic front perspective view of a head of a wearer.
Figure 2:
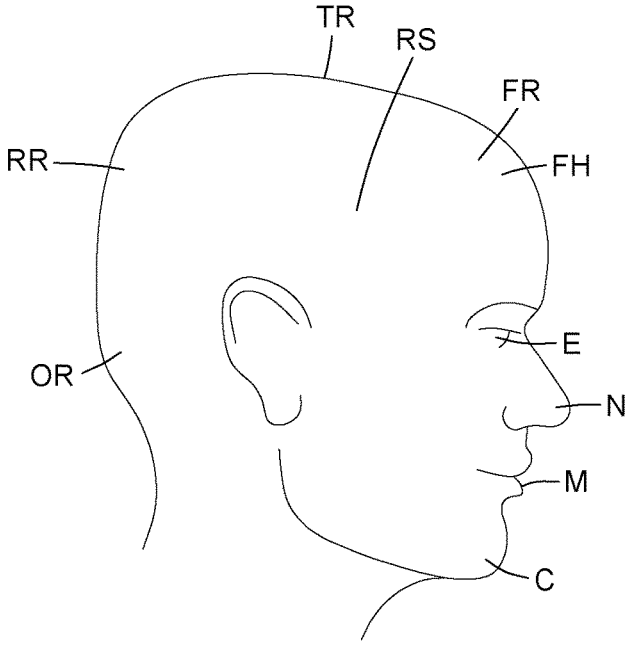
FIG. 2 is a schematic side view of the wearer's head of FIG. 1.

Referring to FIGS. 1-2, a wearer's head is shown and comprises a front region FR, right and left side regions RS, LS, a rear region RR, and a top region TR. The front region FR includes a face F of the wearer, eyes E, a nose N and a mouth M of the wearer' face F, a chin C, a forehead FH. The right and left side regions RS, LS are located between the front region FR and the rear region RR of the head and include right and left temples and ears and right and left lateral parts of the head in right and left temporal bone areas of the head. The rear region RR has a rear upper part and an occipital region OR comprising an occipital protuberance in a parietal bone area and occipital bone area.

Figure 3:
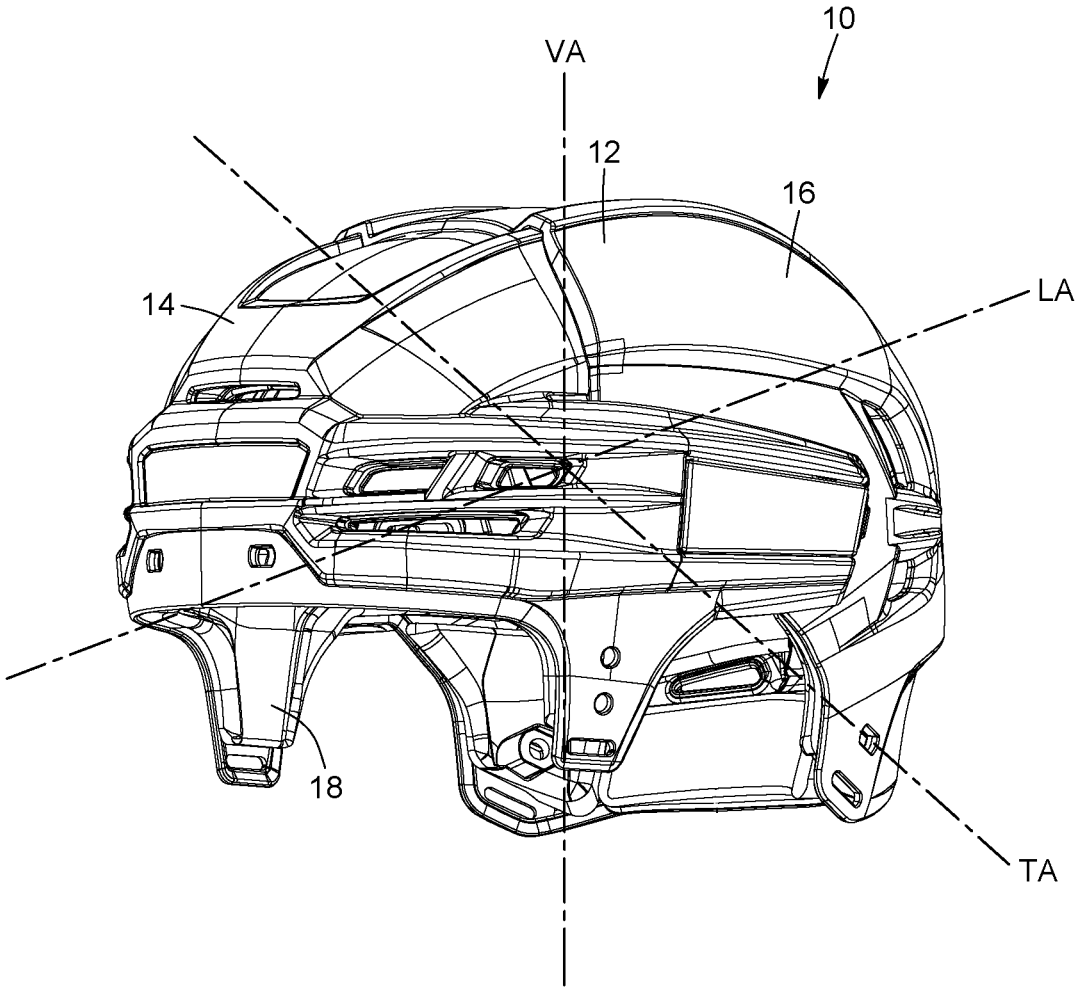
FIG. 3 is a schematic front three dimensional view of a sport helmet in accordance with one embodiment.
Figure 4:
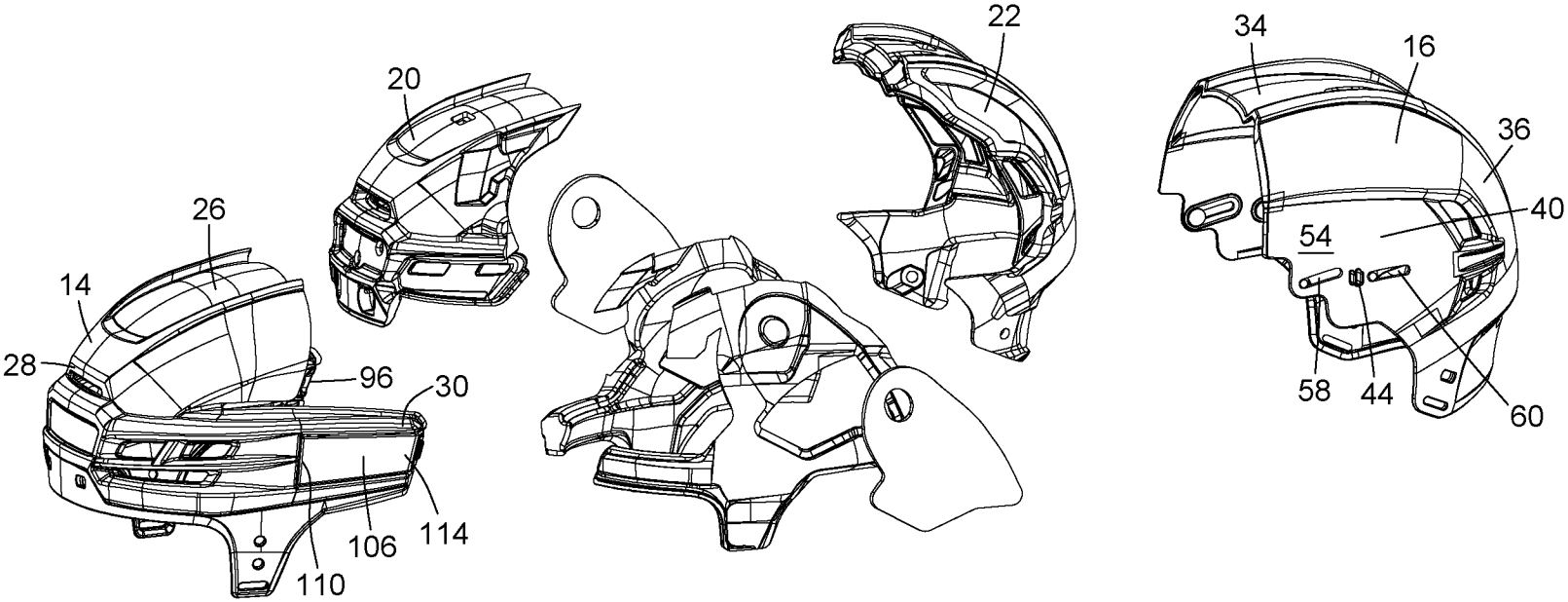
FIG. 4 is a schematic left side three dimensional exploded view of the sport helmet of FIG. 3.
Figure 5:
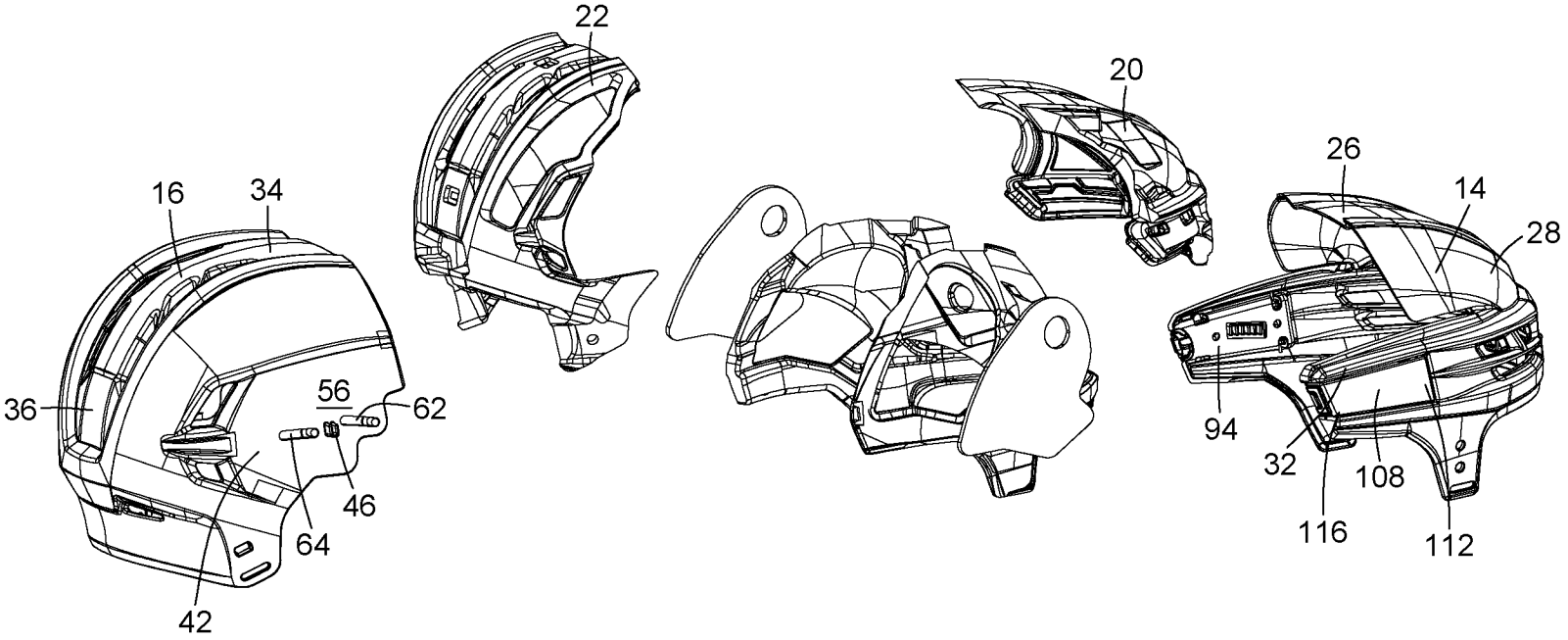
FIG. 5 is a schematic right side three dimensional exploded view of the sport helmet of FIG. 3.

Referring now to FIGS. 3-5, a sport helmet is shown at 10 and defines a cavity for receiving the wearer's head to protect the head when the sport helmet 10 is impacted (e.g., when the sport helmet 10 hits a board, ice or other playing surface or is struck by a puck, ball, a lacrosse or hockey stick, or when the player is receiving a hit (e.g., body check) by another player and the head of the player is hit directly or indirectly).

In the embodiment shown, the sport helmet 10 is a hockey helmet for protecting the head of the wearer who is a hockey player. However, the present disclosure is not limited to any particular type of sport helmet. For example, a sport helmet constructed using principles described herein in respect of the sport helmet 10 may be used for protecting the head of a player of another type of contact sport in which there are significant impact forces on the player due to player-to-player and/or player-to-object contact (lacrosse or football for instance). It is also understood that the sport helmet may be for protecting the head of a wearer involved in a sport other than a contact sport (e.g., bicycling, motorcycle, skiing, snowboarding, horseback riding or another equestrian activity, etc.). The principles of the present disclosure may be used for other types of helmets, such as, for instance, construction helmets.

As shown in FIG. 3, the sport helmet 10 has a longitudinal axis LA extending from the front region FR to the rear region RR (FIG. 1), a transversal axis TA extending from the left side LS to the right side RS, and a vertical axis VA normal to both of the longitudinal and transversal axes LA, TA. These axes LA, TA, VA respectively define a front-back direction, a left-right direction and a vertical direction of the sport helmet 10. The longitudinal axis LA may be seen as an axis that resides within an imaginary longitudinal plan that bisects the helmet which defines left and right sides on each side of the plane.

The sport helmet 10 has an outer shell 12 comprising a first shell 14 and a second shell 16. Herein, the first and second shells 14, 16 are front and rear shells, respectively. It will be appreciated that the first and second shells 14, 16 may alternatively be rear and front shells, respectively. The first and second shells 14, 16 may be made of a relatively rigid material, such as polyethylene, NYLON, polycarbonate materials, thermoplastics, or thermosetting resins or any other suitable material. The outer shell 12 at least partially encloses an inner padding 18. The first shell 14 covers the front region FR (FIG. 1) of the wearer's head whereas the second shell 16 covers the rear region RR (FIG. 1) of the wearer's head. The first and second shells 14, 16 are referred to as the front and rear shells 14, 16, respectively.

Figure 6:
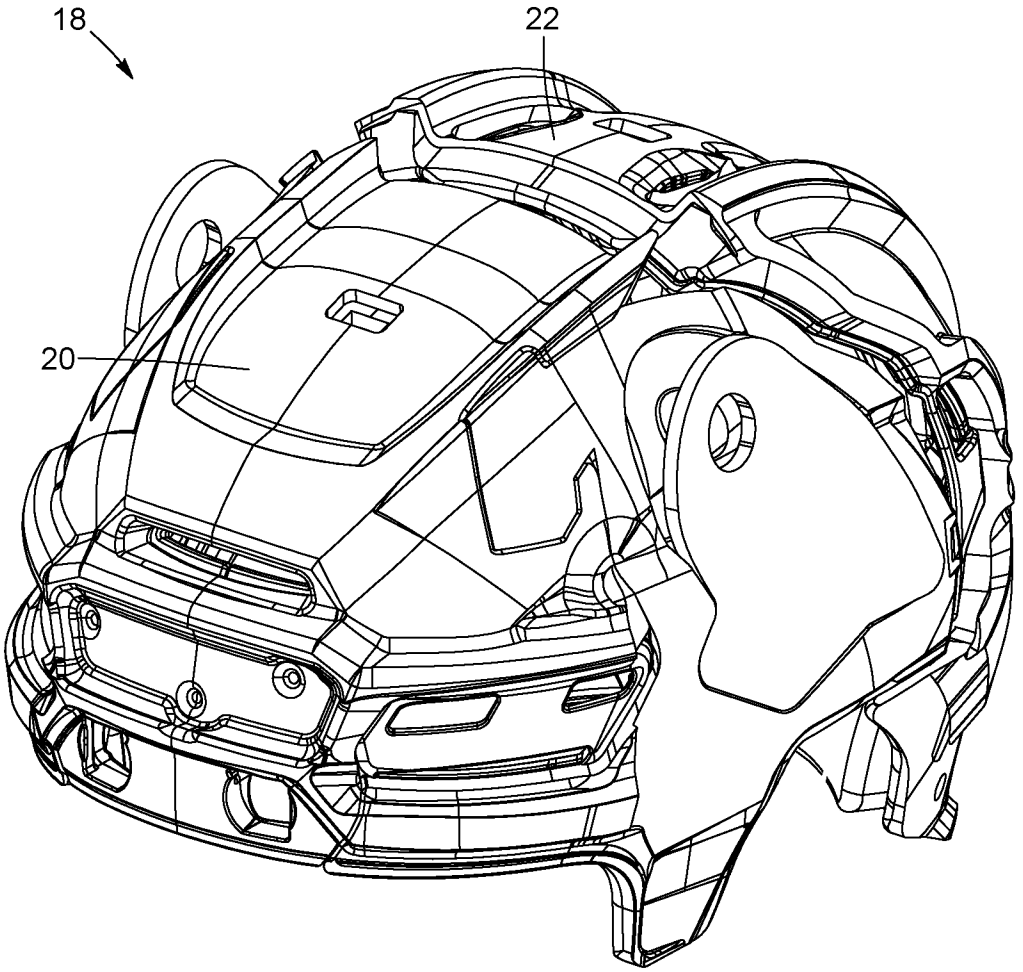
FIG. 6 is a schematic top front left side three dimensional view showing first and second padding portions of the sport helmet of FIG. 3.

Referring more particularly to FIG. 6 with continued reference to FIGS. 3-5, the inner padding 18 comprises a first padding portion 20 for covering at least part of the top region TR of the wearer's head and left and right side regions LS, RS of the wearer's head and a second padding portion 22 for covering at least part of the rear region RR of the wearer's head and top and left and right side regions LS, RS of the wearer's head. In the sport helmet 10, the first and second padding portions 20, 22 are front and rear padding portions. The first and second padding portions 20, 22 are at least partially covered by the first and second shells 14, 16, respectively.

It will be appreciated that the first and second padding portions 20, 22 include shock-absorbing material to absorb impact energy when the sport helmet 10 is impacted. Any suitable shock-absorbing material may be used. For example, the shock-absorbing material may include a polymeric cellular material, such as a polymeric foam (e.g., expanded polypropylene (EPP) foam, expanded polyethylene (EPE) foam, vinyl nitrile (VN) foam, polyurethane foam, or any other suitable polymeric foam material), or expanded polymeric microspheres. In some cases, the shock-absorbing material may include an elastomeric material (e.g., a rubber such as styrene-butadiene rubber or any other suitable rubber); a polyurethane elastomer such as thermoplastic polyurethane (TPU); any other thermoplastic elastomer; etc.). In some cases, the shock-absorbing material may include a fluid (e.g., a liquid or a gas), which may be contained within a container (e.g., a flexible bag, pouch or other envelope) or implemented as a gel (e.g., a polyurethane gel). Any other material with suitable impact energy absorption may be used for the first and second padding portions 20, 22. It is understood that the inner padding 18 may comprise any number of pads and the sport helmet 10 may also comprise other types of pads such as comfort pads made of polymeric foam such as polyvinyl chloride (PVC) foam or polyurethane foam.

The front padding portion 20 has a three-dimensional external configuration that matches the three-dimensional internal configuration of the first shell 14 and is mounted to the first shell 14 by any suitable affixing means, such as glue, stitches, tacks, staples or rivets. Similarly, the rear padding portion 22 has a three-dimensional external configuration that matches the three-dimensional internal configuration of the second shell 16 and is mounted to the second shell 16 by any suitable means, such as glue, stitches, tacks, staples or rivets.

Although not shown, it will be appreciated that the sport helmet 10 may be equipped with ear loops and a chinstrap for securing the sport helmet 10 to the wearer's head. The sport helmet 10 may further comprise ear protectors for protecting the left and right ears of the wearer.

It will be appreciated that the first and second shells 14, 16 and the first and second padding portions 20, 22 define a plurality of ventilation holes, passages or apertures for allowing air to circulate around the wearer's head.

Figure 7:
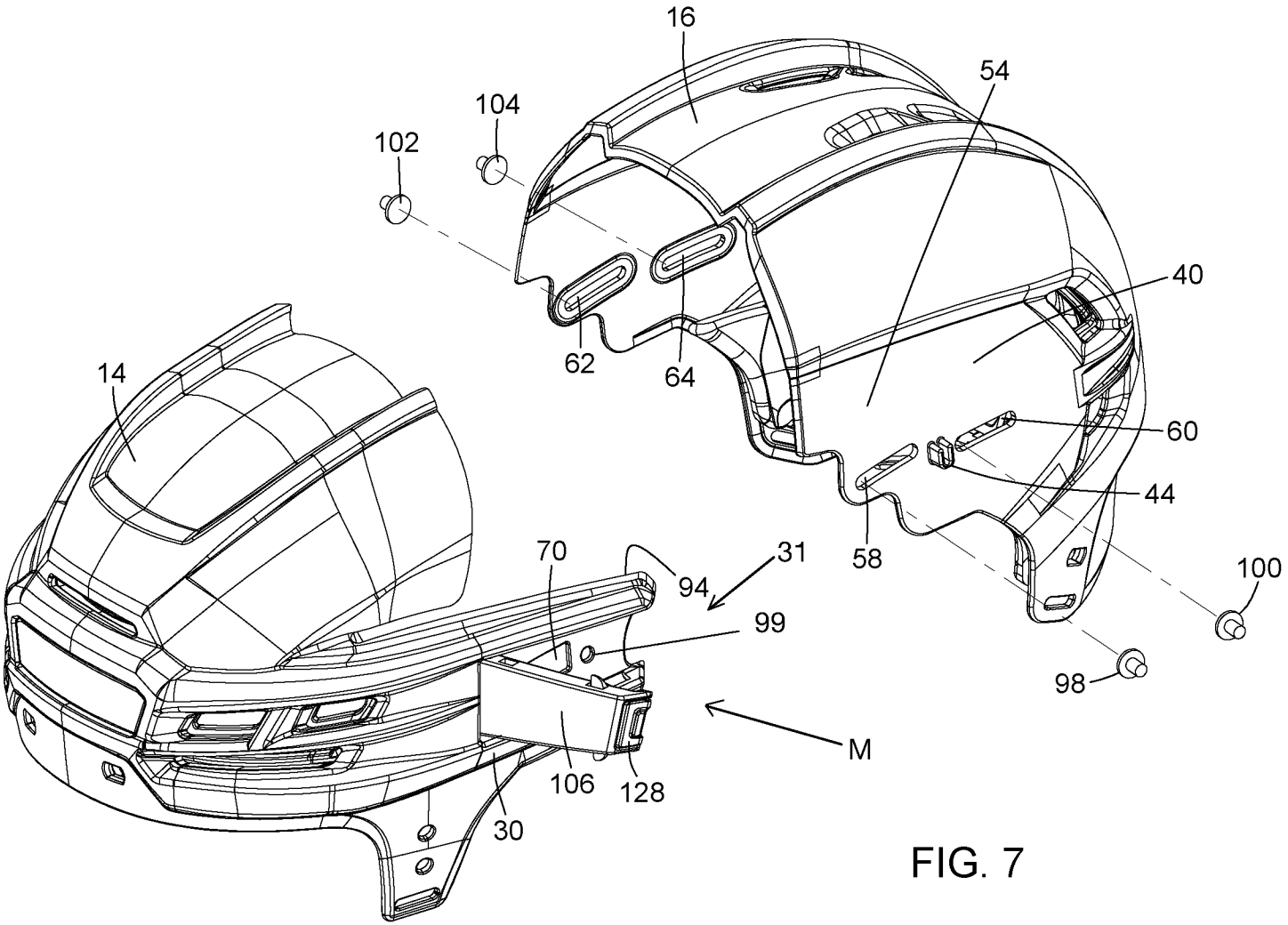
FIG. 7 is a schematic top left side three dimensional exploded view showing first and second shells of the sport helmet of FIG. 3.
Figure 8:
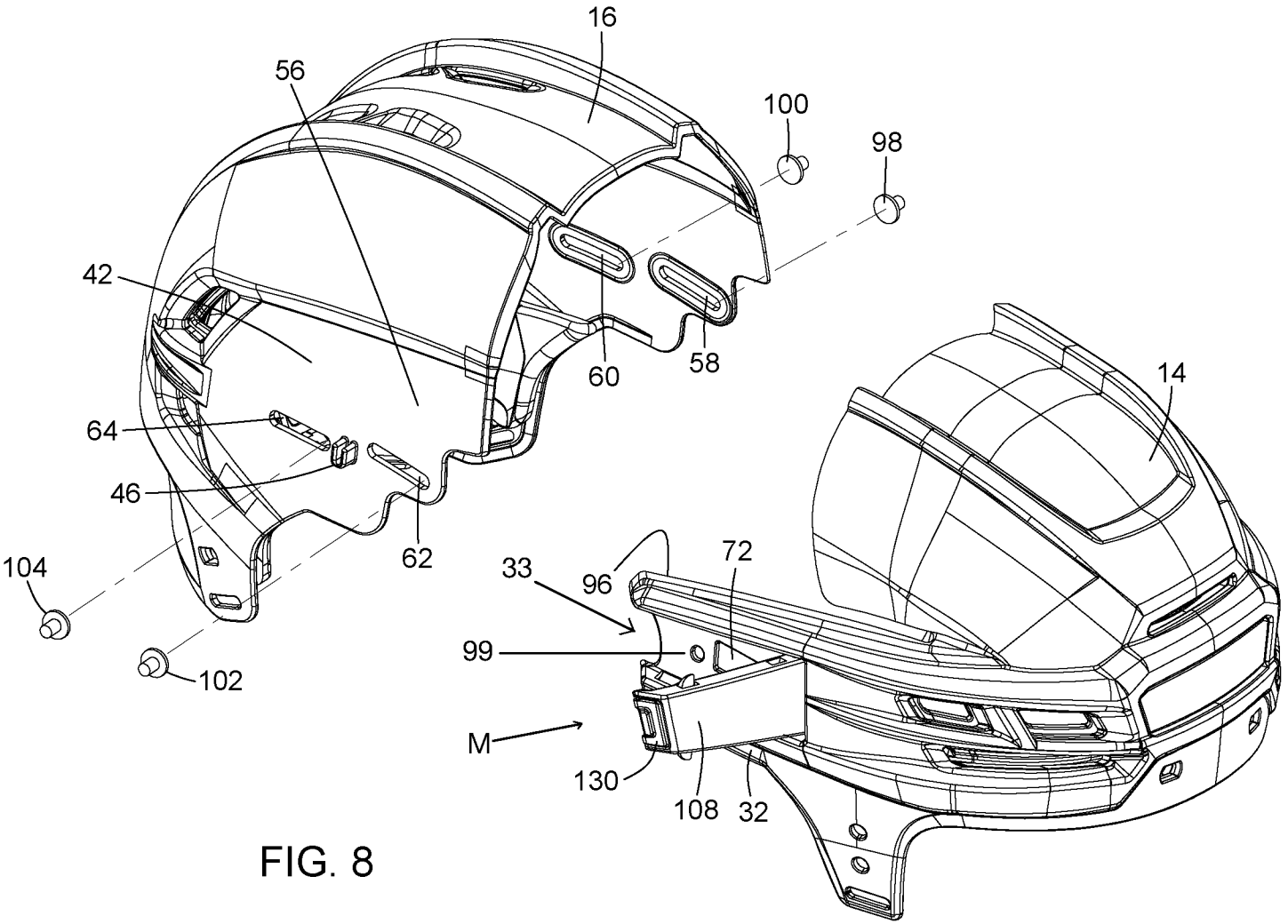
FIG. 8 is a schematic top right side three dimensional exploded view showing the first and second shells of the sport helmet of FIG. 3.

Referring to FIGS. 4-5, the first shell 14 comprises a top portion 26, a front portion 28 and left and right side portions 30, 32 extending or protruding rearwardly from the front portion 28 to distal ends 31, 33 (FIGS. 7-8). In the embodiment shown, the left and right side portions 30, 32 are cantilevered relative to the front portion 28 of the first shell 14. The second shell 16 comprises a top portion 34, a rear portion 36 and left and right side portions 40, 42 extending forwardly from the rear portion 36. The first and second shells 14, 16 of the sport helmet 10 at least partially enclose the first and second padding portions 20, 22. In the drawings, the first and second shells 14, 16 are front and real shells and the first and second padding portions 20, 22 are front and rear padding portions. It is understood that the terms "first shell", "second shell", "first padding portion", and "second padding portion" also cover a sport helmet wherein the first and second shells are respective rear and front shells and the first and second padding portions are respective rear and front padding portions.

The sport helmet 10 is an adjustable sport helmet wherein the outer shell 12 and the inner padding 18 are adjustable to adjust the fit of the sport helmet 10 on the wearer's head. To that end, the first shell 14 and first padding portion 20 are movable relative to the second shell 16 and second padding portion 22 to adjust the fit of the sport helmet 10 on the wearer's head. It is understood that the expression "the first shell moves relative to the second shell" covers movements of the first and second shells in relation to each other wherein both shells are movable in relation to each other, wherein only the first shell is movable in relation to the second shell or wherein only the second shell is movable in relation to the first shell. Relative movement of the first and second shells for adjustment purposes is herein along the longitudinal axis LA (FIG. 3) in the front-back direction of the sport helmet 10 such that the front-back internal dimension of the cavity of the sport helmet 10 is adjusted.

The means for attaching the first shell 14 to the second shell 16 are described below. Then, the means that allow a size of the helmet 10 to be adjusted by movement of the first shell 14 relative to the second shells 16 are described.

Referring to FIGS. 7 and 8, the left and right first side portions 30, 32 of the first shell 14 comprise left and right first inner surfaces 94, 96. The left and right first inner surfaces 94, 96 of the first shell 14 at least partially overlap left and right second outer surfaces 54, 56 of the second shell 16 for defining respective inner and outer left and right sliding surfaces. The left and right sliding surfaces of the first and second shells 14, 16 are retained together by respective first and second left and right connectors 98, 100; 102, 104 such that they fit together in an overlapping relationship. Those connectors 98, 100, 102, 104 are received within slots and apertures. More specifically, the left and right second side portions 40, 42 of the second shell 16 have first and second left longitudinal slots 58, 60 and first and second right longitudinal slots 62, 64. The first and second right and left slots 58, 60, 62, 64 are offset one relative to the other about the longitudinal axis LA (FIG. 3). More detail about the relative positions of these slots are presented below.

In the present embodiment, the front and rear shells 14, 16 are secured to one another via the first and second left connectors 98, 100 and first and second right connectors 102, 104. The connectors 98, 100, 102, 104 are received within correspondingly sized apertures 99 defined through the side portions 30, 32 of the front shell 14. Once the front and rear shells 14, 16 are assembled, each of the four longitudinal slots 58, 60, 62, 64 is aligned with a respective one of the four apertures 99. The first and second left connectors 98, 100 are received through respective ones of the apertures 99 of the first shell 14 and slidably mounted in the first and second left longitudinal slots 58, 60 of the second shell 16. The first and second right connectors 102, 104 are received through respective ones of the apertures 99 of the first shell 14 and slidably mounted in the first and second right longitudinal slots 62, 64 of the second shell 16.

In use, when the first shell 14 moves relative to the second shell 16, the first and second left connectors 98, 100 slide in the first and second left longitudinal slots 58, 60 of the rear shell 16 and the first and second right connectors 102, 104 slide in the first and second right longitudinal slots 62, 64 of the rear shell. The connectors 98, 100, 102, 104 may be, for instance, rivets, nuts and bolts, or any suitable connectors.

Extremities of the longitudinal slots 58, 60, 62, 64 define forward and rearward limits of movements of the front shell 14 relative to the rear shell 16 by having the connectors 98, 100, 102, 104, which are fixed relative to the front shell 14, abuttable against the extremities of the longitudinal slots 58, 60, 62, 64.

Still referring to FIGS. 7-8, the helmet 10 includes left and right adjustment mechanisms M to change a size of the helmet 10. The left side portion 40 of the second shell 16 comprises a left engaging member of the left adjustment mechanism M, referred to herein below as a left outer tooth 44, extending outwardly and transversely therefrom. Similarly, the right side portion 42 of the second shell 16 comprises a right engaging member of the right adjustment mechanism M, referred to herein below as a right outer tooth 46, extending outwardly and transversely therefrom. The left and right teeth 44, 46 extend away from one another from the rear shell 16 in a direction having a component in a transversal direction defined by the transversal axis TA (FIG. 3).

In the embodiment shown, the first left and right longitudinal slots 58, 62 are located forwardly of the left and right outer teeth 44, 46 and the second left and right longitudinal slots 60, 64 are located rearwardly of the left and right outer teeth 44, 46. In other words, each of the left and right outer teeth 44, 46 is located between two of the slots 58, 60, 62, 64.

Using two slots 58, 60 on the left side and two slots 62, 64 on the right side may prevent rotation of the first shell 14 relative to the second shell 16 about the transversal axis TA (FIG. 1) during an adjustment of the size of the helmet 10. In other words, in the depicted embodiment at least four slots (e.g. two slots on the left side and two slots on the right side) are provided and may allow for an increased stability of the helmet 10. It is however to be understood that fewer than four slots may alternately be provided. For example, three slots may be alternately be used—one slot on each side and a third at the top or other suitable portion of the shells.

It will be appreciated that, in an alternate embodiment, the helmet may include only two slots, namely a left longitudinal slot and a right longitudinal slot, and a left connector and a right connector. Both of the left and right connectors may have a cross-section defining an anti-rotational feature. For instance, the connectors may be square in cross-section and sized to define a sliding engagement with walls delimiting the left and right longitudinal slots. The first shell may be non-rotatable relative to the second shell thanks to the square connectors slidingly received within the left and right longitudinal slots.

In an alternate embodiment, the helmet 10 may include three longitudinal slots, for example a top longitudinal slot on a top portion of the helmet 10, a left longitudinal slot, and a right longitudinal slot.

Figure 9:
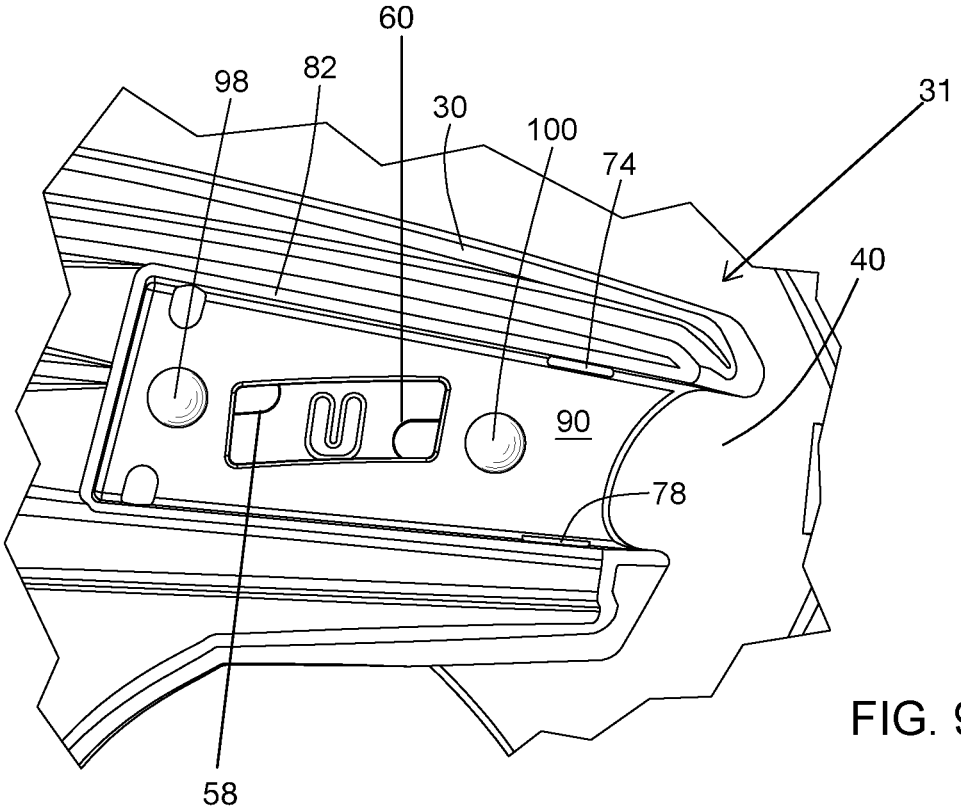
FIG. 9 is a schematic partial enlarged left side view of the first and second shells and with a left lever being removed for illustration purposes.

In the present embodiment, and as shown in FIGS. 7 and 9, the two longitudinal slots 58, 60 are both longitudinally and vertically offset from one another relative to the longitudinal and vertical axes LA, VA (FIG. 3). This offset allows to receive the left and right outer teeth 44, 46 between the longitudinal slots 58, 60, 62, 64. In the embodiment shown, the two left longitudinal slots 58, 60 are devoid of any overlap between them. In other words, a top edge of a bottom one 60 of the two left longitudinal slots 58, 60 is below a bottom edge of the top one 58 of the two left longitudinal slots 58, 60. Moreover, a rearward-most extremity of a forward one 58 of the two left longitudinal slots 58, 60 is located forward of a forward-most extremity of a rearward one 60 of the two left longitudinal slots 58, 60. The same applies herein for the two right longitudinal slots 62, 64. In the present case, the forward ones 58, 62 of the left and right longitudinal slots 58, 60, 62, 64 are located higher than the rearward ones 60, 64 of the left and right longitudinal slots 58, 60, 62, 64. Stated differently, the forward longitudinal slots 58, 62 are closer to a top of the helmet 10 than the rearward longitudinal slots 60, 64. The two left slots 58, 60, and the two right slots 62, 64 may be curved.

Referring now to FIGS. 9-12, the left and right first side portions 30, 32 of the first shell 14 define left and right housings or recesses 66, 68. The left and right housings or recesses 66, 68 of the first shell 14 are defined by left and right upper walls 82, 84 extending outwardly and longitudinally on the left and right first side portions 30, 32, left and right lower walls 86, 88 extending outwardly and longitudinally on the left and right first side portions 30, 32, and left and right side walls 90, 92 connected to the left and right upper and lower walls 82, 84; 86, 88 and extending longitudinally on the left and right first side portions 30, 32. In the embodiment shown, the housings 66, 68 are open at the distal ends 31, 32 of the side portions 30, 32.

The left and right side portions 30, 32 comprise left and right openings 70, 72 extending through a thickness of the left and right first side walls 90, 92 of the front shell 14 and sized to receive therethrough the left and right outer teeth 44, 46 of the second shell 16. As illustrated more clearly in FIGS. 9 and 11, a length of the left and right openings 70, 72 taken along the longitudinal axis LA (FIG. 3) is greater than that of the teeth 44, 46 to allow relative motion between the first and second shells 14, 16.

In the embodiment shown, left and right upper anchoring apertures 74, 76 and left and right lower anchoring apertures 78, 80 are defined by the first shell 14. The left and right upper anchoring apertures 74, 76 extend from the left and right upper walls 82, 84. Similarly, the left and right lower anchoring apertures 78, 80 extend from the left and right lower walls 86, 88.

Figure 15:
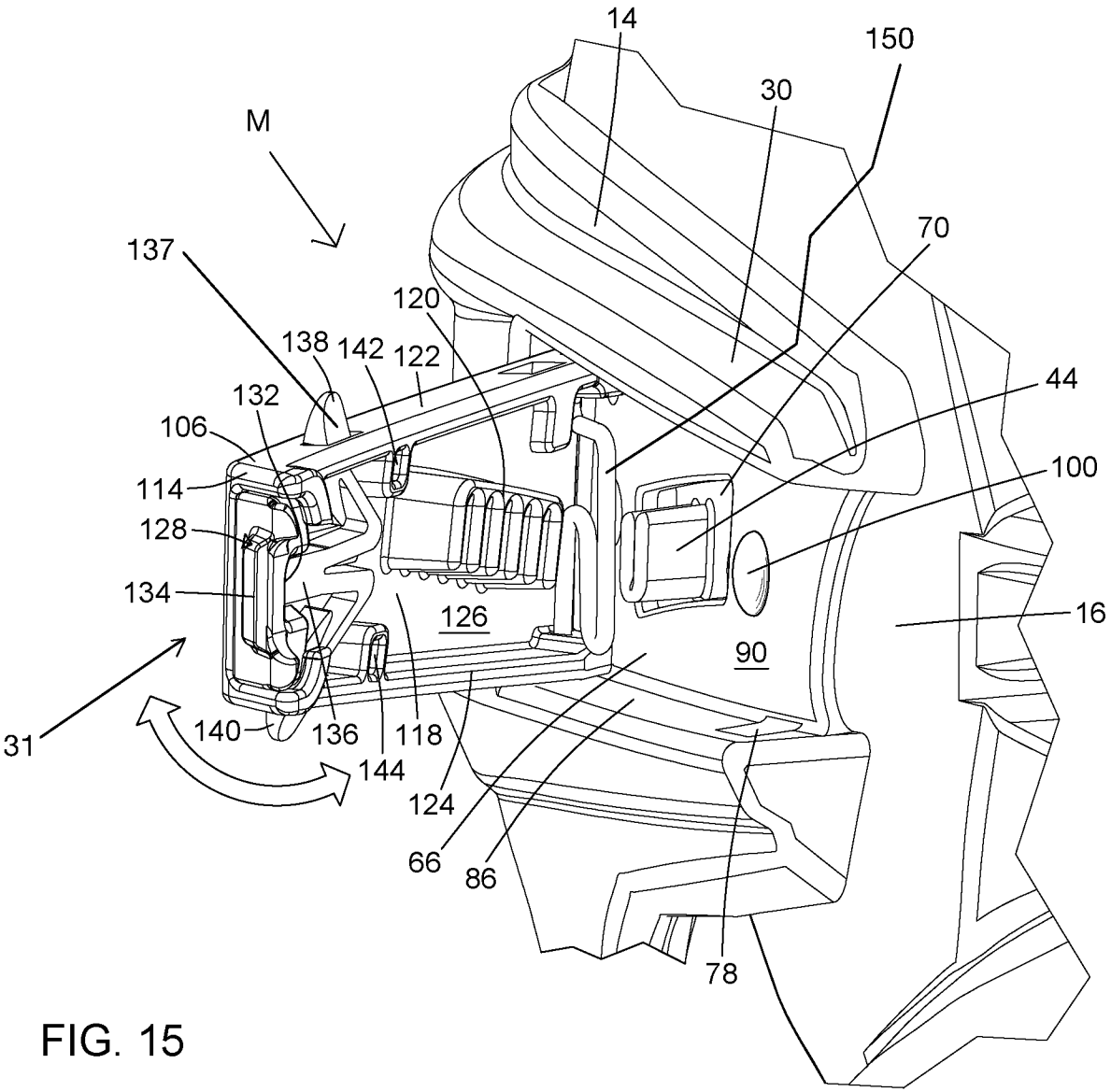
FIGS. 15 and 16 are schematic partial enlarged left side three dimensional views of the front and rear shells of the helmet of FIG. 3 with the left lever in an open position.
Figure 16:
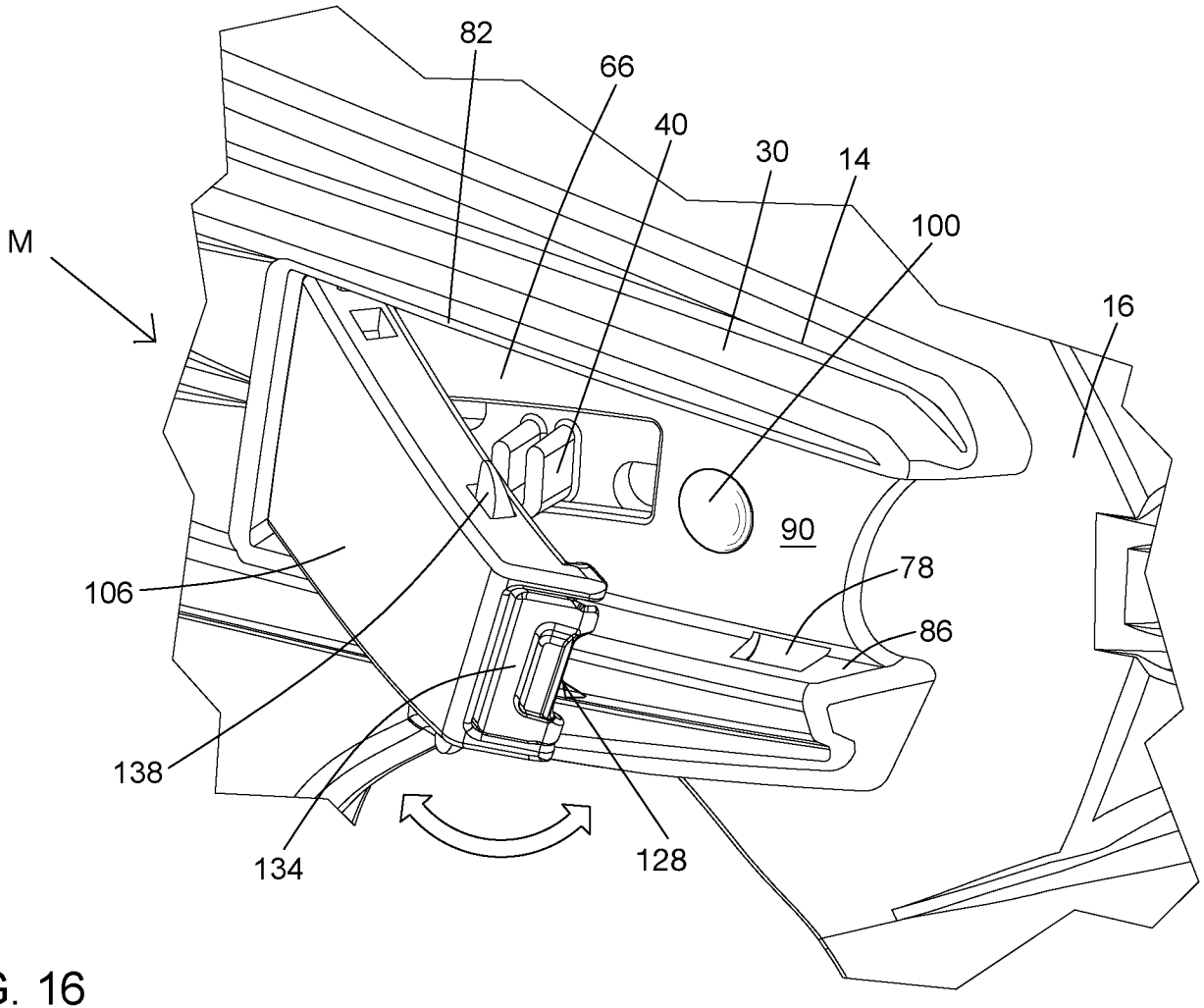

Referring more specifically to FIGS. 15 and 16, the left and right adjustment mechanism M of the sport helmet 10 includes left and right manually operable levers 106, 108 that are hingedly connected to respective left and right sides of the first shell 14 and that are sized to at least partially fit within the left and right housings 66, 68. The left and right levers 106, 108 extend from left and right first ends 110, 112 (FIGS. 4-5) to left and right second ends 114, 116 (FIGS. 4-5) opposite to the left and second first ends 110, 112. The left and right first ends 110, 112 are pivotably mounted to the left and right first side portions 30, 32 of the first shell 14 such that the left and right levers 106, 108 are each pivotable with respect to the first shell 14 between a first or engaged position (as seen in FIGS. 4 and 5) and a second or disengaged position (as seen in FIGS. 7, 8, 15 and 16). In the embodiment shown, the left and right first ends 110, 112 are located forward of the left and right second ends 114, 116 such that, when moving from the first position to the second position, the left and right second ends 114, 116 move toward the front of the helmet 10.

The left lever 106 defines a left recess 118 extending longitudinally from the left second end 114. Similarly, it is understood that the right lever 108 defines a right recess extending longitudinally from right second end 116. Those recesses are partially enclosed by left and right lever walls and by peripheral lever walls.

The left recess 118 of the left lever 106 is defined by a left top wall 122 extending longitudinally from the left second end 114, a left bottom wall 124 extending longitudinally from the left second end 114 and a left side or lateral wall 126 (see FIG. 15) connected to the left top and bottom walls 122, 124 and extending longitudinally from the left second end 114. Similarly, the right recess of the right lever 108 is defined by a right top wall extending longitudinally from the right second end 116, a right bottom wall extending longitudinally from the right second end 116 and a right side wall connected to the right top and bottom walls and extending longitudinally from the right second end 116.

The left lever 106 is engageable to the left outer tooth 44 of the second shell 16 to limit relative movement between the first and second shells 14, 16 when the left lever 106 is in the first position. In the embodiment shown, the left lever 106 comprises a left engaging member such as a plurality of left inner teeth 120. Similarly, the right lever 108 is engageable to the right outer tooth 46 of the second shell 16 to limit relative movement between the first and second shells 14, 16 when the right lever 106 is in the first position. To this end, as for the left lever 106, it is understood that the right lever comprises a right engaging member, herein a plurality of right inner teeth. In the embodiment shown, each of the plurality of left and right inner teeth is receivable with the cavities 52 (FIGS. 10 and 12) defined by the left and right outer teeth 44, 46. The dimension of the helmet 10 is modified by selecting two different ones of the right and left inner teeth 120 to be received with the cavities 52 of the left and right outer teeth 44, 46.

Figure 10:
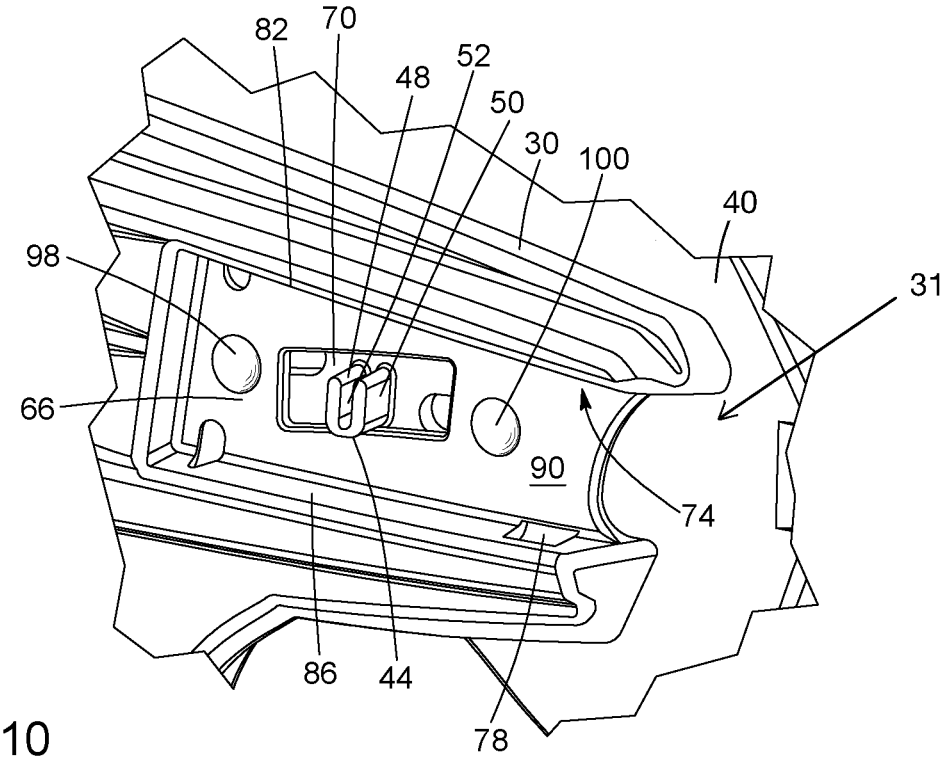
FIG. 10 is a schematic partial enlarged left side three dimensional view of the first and second shells and with the left lever being removed for illustration purposes.
Figure 11:
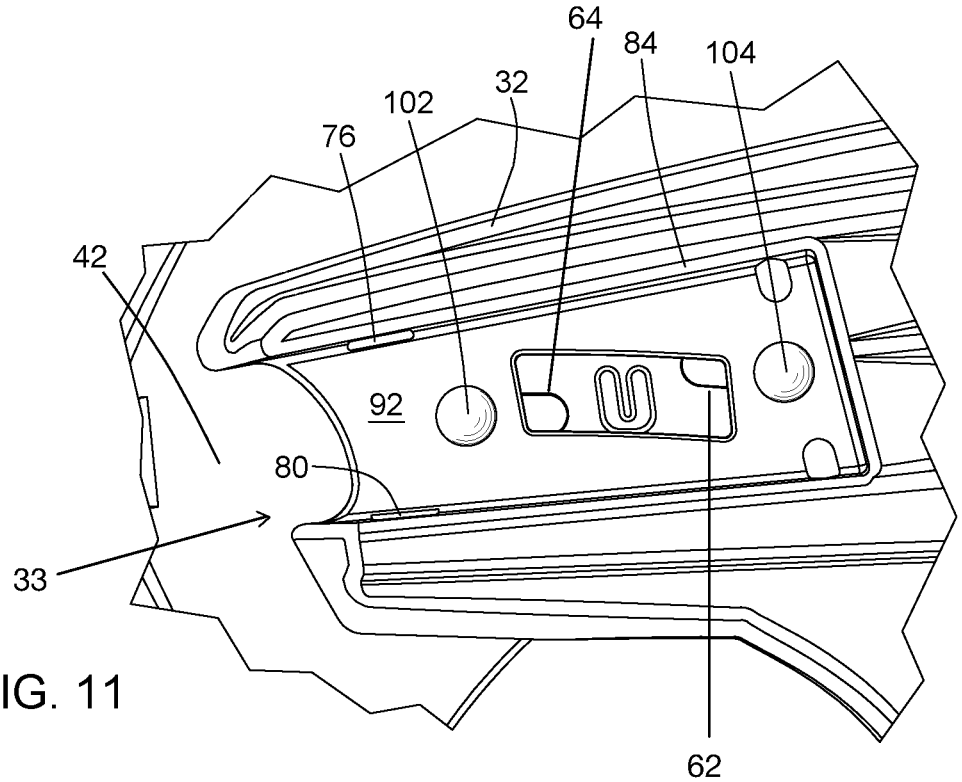
FIG. 11 is a schematic partial enlarged right side view of the front and rear shells and with a right lever being removed for illustration purposes.
Figure 12:
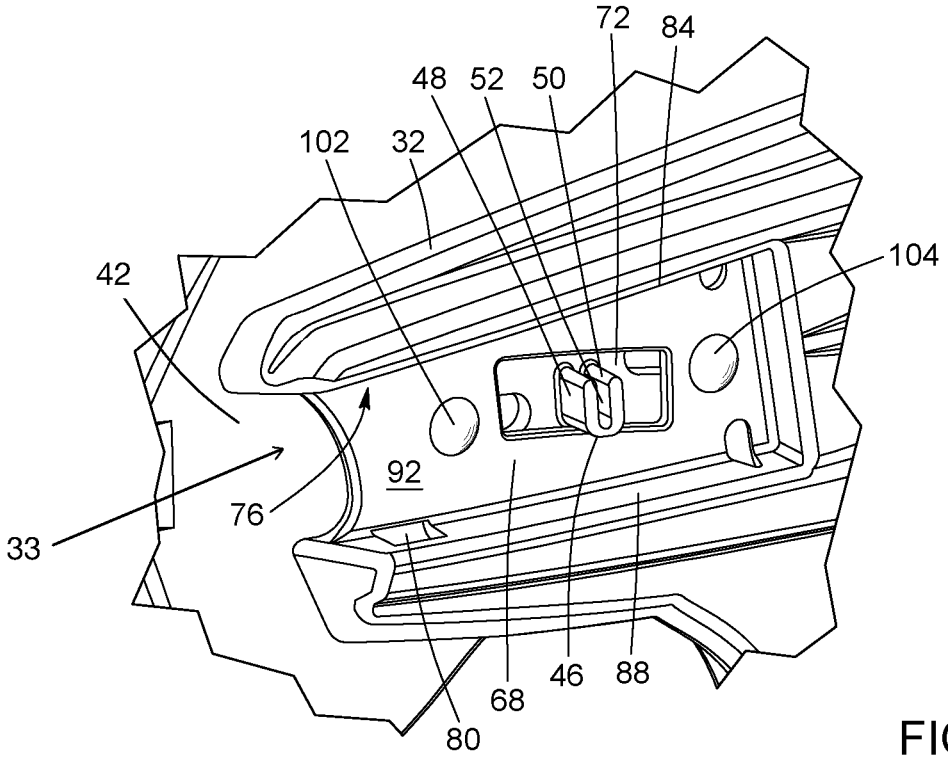
FIG. 12 is a schematic partial enlarged right side three dimensional view of the front and rear shells and with the right lever being removed for illustration purposes.

Referring to FIGS. 10 and 12, each of the left and right outer teeth 44, 46 of the second shell 16 have a U-shape with first and second legs 48, 50 defining a space 52 therebetween. It will be appreciated that any suitable shape of the teeth 44, 46 is contemplated. For instance, the outer teeth 44, 46 may be two ribs spaced apart from one another in a manner to slidably receive therein ribs defined by the levers 66, 68. Other shape than U-shape are contemplated, such as, for instance, V-shape, n-shape, and so on. The inner teeth of the levers 66, 68 may be pins and the outer teeth 44, 46 of the second shell 16 may alternatively be apertures for receiving the pins. Any configuration allowing a locking engagement between engaging members of the levers 66, 68 and of the second shell 16 is contemplated without departing from the scope of the present disclosure.

Referring back to FIGS. 7-8, in the embodiment shown, the left and right levers 106, 108 cover the slots 58, 60, 62, 64 and the apertures 99. The positioning of the longitudinal slots 58, 60 and 62, 64 may yield more space on the second shell 16 to receive the outer teeth 44, 46. That is, if the longitudinal slots 58, 60, 62, 64 were vertically aligned, the longitudinal slots 58, 60, 62, 64 would have to be more longitudinally spaced apart from one another for structural reasons. If the longitudinal slots 58, 60, 62, 64 were longitudinally aligned, greater spacing between them would be required and this might prevent the levers 106, 108 from covering the longitudinal slots 58, 60, 62, 64. The above features of the longitudinal slots 58, 60, 62, 64 may allow for a compact configuration that may enable the connectors 98, 100, 102, 104 and the openings 70, 72 to fit all under the levers 106, 108 and to be covered by said levers 106, 108. The slots 58, 60, 62, 64 and openings 70, 72 are therefore hidden by the levers 106, 108.

Figure 13:
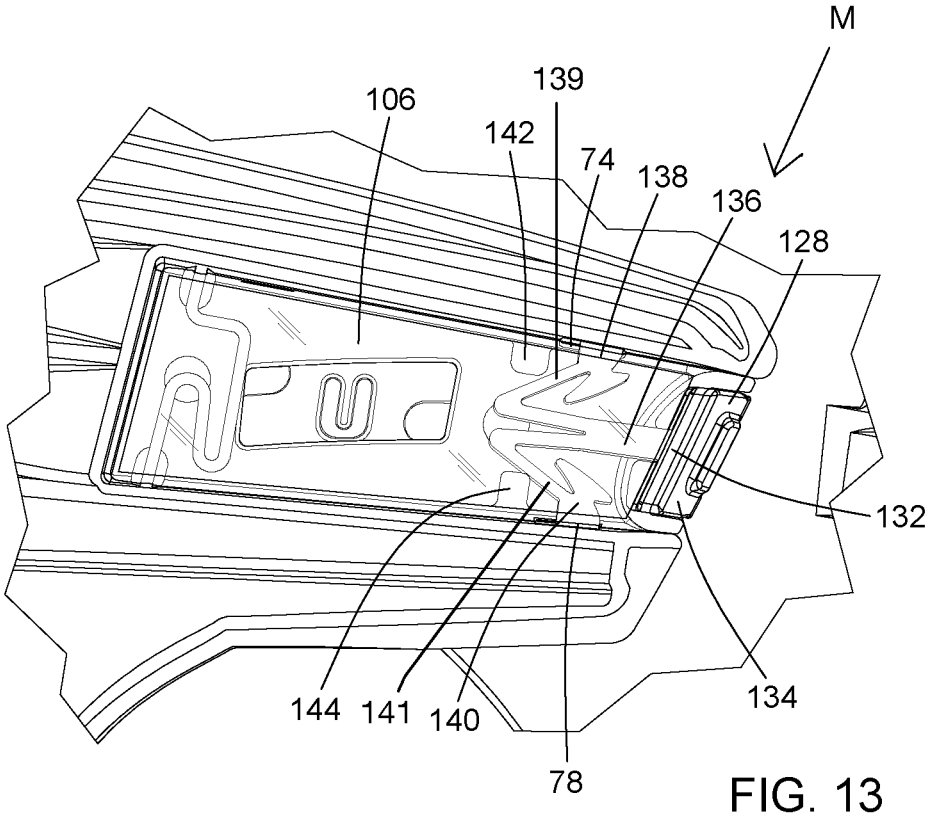
FIGS. 13 and 14 are schematic partial enlarged left side views of the front and rear shells with the left lever shown as transparent for illustration purposes and illustrating a left actuator in a locked position (FIG. 13) and in an unlocked position (FIG. 14)
Figure 14:
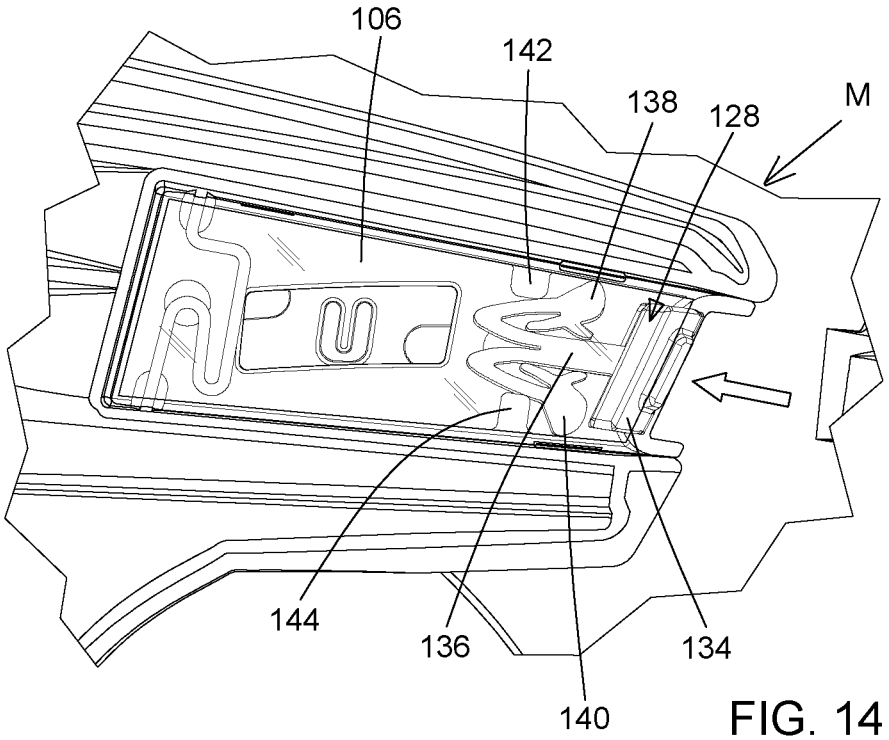

Referring to FIGS. 13 to 15, the sport helmet 10 includes left and right locking actuators 128, 130 being at least partially mounted within the left and right recesses 118 of the left and right levers 106, 108. The left locking actuator 128 comprises a left wall 132 defining a left finger-engaging surface 134 accessible by at least one finger of the wearer and a left member 136 extending forwardly from the left wall and having a left upper anchoring projection 138 extending upwardly. In the present embodiment, the left member 136 has a left lower anchoring projection 140 extending downwardly. It will be appreciated that, alternatively, only one of the upper and lower anchoring projections 138, 140 may be used. Similarly, it will be appreciated that the right locking actuator 130 comprises a right wall having a right finger-engaging surface accessible by at least one finger of the wearer and a right member extending from the right wall and having a right anchoring projection extending upwardly. The right member may also comprise a right anchoring projection extending downwardly.

Each of the left and right locking actuators 128, 130 is movable between a locked position (FIG. 13) wherein pivotable movement of each of the left and right levers 106, 108 relative to the front shell 14 is limited and an unlocked position (FIG. 14) wherein pivotable movement of each of the left and right levers 106, 108 is allowed such that the left and right levers 106, 108 are movable by the wearer from the first position (as seen in FIGS. 4 and 5) to the second position (as seen in FIGS. 7, 8, 15 and 16).

In the embodiment shown, in the locked position depicted in FIG. 13, which shows the left lever 106 as transparent and wherein the left inner teeth 120 are omitted for illustrative purposes, the left and right upper and lower anchoring projections 138, 140 of the left and right locking actuators 128, 130 are at least partially received within the left and right upper anchoring apertures 74, 76 and in the left and right lower anchoring apertures 78, 80. As explained above, it will be appreciated that only the upper or the lower projections/apertures may be present. If the left and right levers 106, 108 are provided with top and bottom walls (e.g. top and bottom walls 122, 124), each top wall may comprise a top passage and each bottom wall may comprise a bottom passage for receiving the upper and lower anchoring projections of the left and right locking actuators 128, 130.

In the embodiment shown, the upper and lower anchoring projections 138, 140 are located at respective distal ends of upper and lower flexible arms 139, 141 (FIG. 14) that are secured at their proximal ends to the members 136, which protrude from the left and right locking actuators 128, 130. Each of the upper and lower flexible arms 139, 141 are abuttable against a top abutting notch 142 extending downwardly from the top wall 122 and a bottom abutting notch 144 extending upwardly from the bottom wall 124. When the upper and lower flexible arms 139, 141 abut the top and bottom abutting notches 142, 144, the upper and lower flexible arms 139, 141 deflected toward the member 136 and move toward one another thereby disengaging the upper and lower anchoring projections 138, 140 from their respective upper and lower anchoring apertures 74, 76, 78, 80 (FIGS. 9-12).

More specifically, in response to the at least one finger of the wearer acting on the respective left and right finger-engaging surfaces 134 of the left and right locking actuators 128, 130, each of the left and right locking actuators 128, 130 are moved by the wearer from the locked position depicted in FIG. 13 to the unlocked position shown in FIG. 14 and in which the left and right upper and lower anchoring projections 138, 140 no longer engaged within the left and right anchoring apertures (74, 76; 78; 80) and in which the wearer is able to then pivot the left and right levers 106, 108 relative to the front shell 14 into the second position depicted in FIG. 15.

Once the left and right levers 106, 108 are pivoted by the wearer into the second position as shown in FIG. 15, the left and right levers 106, 108 no longer engage the outer teeth 44, 46 of the second shell 16. This allows movement of the first shell 14 relative to the second shell 16. That way, the wearer is able to vary the internal volume of the cavity of the sport helmet 10 by adjusting the longitudinal dimension of the cavity and for adjusting the fit of the sport helmet 10 over the wearer's head. For instance, the wearer is able to adjust the fit by increasing the longitudinal dimension or internal volume of the cavity from a first longitudinal dimension or a first volume (see FIG. 17) to a second larger longitudinal dimension or a second internal volume (see FIG. 19).

Referring to FIGS. 15-16, in the embodiment shown, the levers 106, 108 are attached to the first shell 14 via left and right hinges 150. Herein, the left and right hinges 150 are rods having opposed distal portions each slidably received within upper and lower apertures defined through the top and bottom walls 122, 124 of the levers 106, 108 and through apertures defined through the top and bottom walls 82, 86, 84, 88 of the recesses 66, 68. The rods of the left and right hinges 150 are bent and each define a S-shape portion to allow bending for insertion of the rods into the aforementioned apertures. It will be appreciated that the hinges 150 may have other shapes than the one shown in FIG. 15. For instance, the hinge may alternatively be a straight pin. Any suitable hinge may be used without departing from the scope of the present disclosure.

In the embodiment shown, the hinges 150 are located opposite the distal ends 31, 33 of the side portions 30, 32 of the first shell 14. In other words, the hinges 150 and the distal ends 31, 33 are located proximate respective opposite extremities of the recesses 66, 68. In the present embodiment, the hinges 150 and the locking actuators 128, 130 are located at respective opposite ends of the levers 106, 108. By so locating the hinges 150 relative to the locking actuators 128, 130 and in between the top and bottom walls 122, 124 of the levers 106, 108, a structural integrity of the side portions 30, 32 of the first shell 14 is increased on a protection of the wearer's point of view. Stated differently, the levers 106, 108 may help in protecting the wearer from impacts. Moreover, having the hinges 150 and the locking actuators 128, 130 at the respective opposite ends of the levers 106, 108 and having the hinges 150 in between the upper or lower walls 84, 86, 88, 90 of the housings 66, 68 may allow to maintain a structural integrity of the helmet 10 even if the two shells 14, 16 are movable relative to one another. Having the hinges located opposite the distal ends 31, 33 of the side portions 30, 32 of the first shell 14 may allow to avoid using an end wall for the housings 66, 68. It is appreciated that other configurations are contemplated and that it may be possible to have the hinges 150 aft of the housings 66, 68; the locking actuators 128, 130 may be located in a fore portion of the housings 66, 68.

Figure 17:
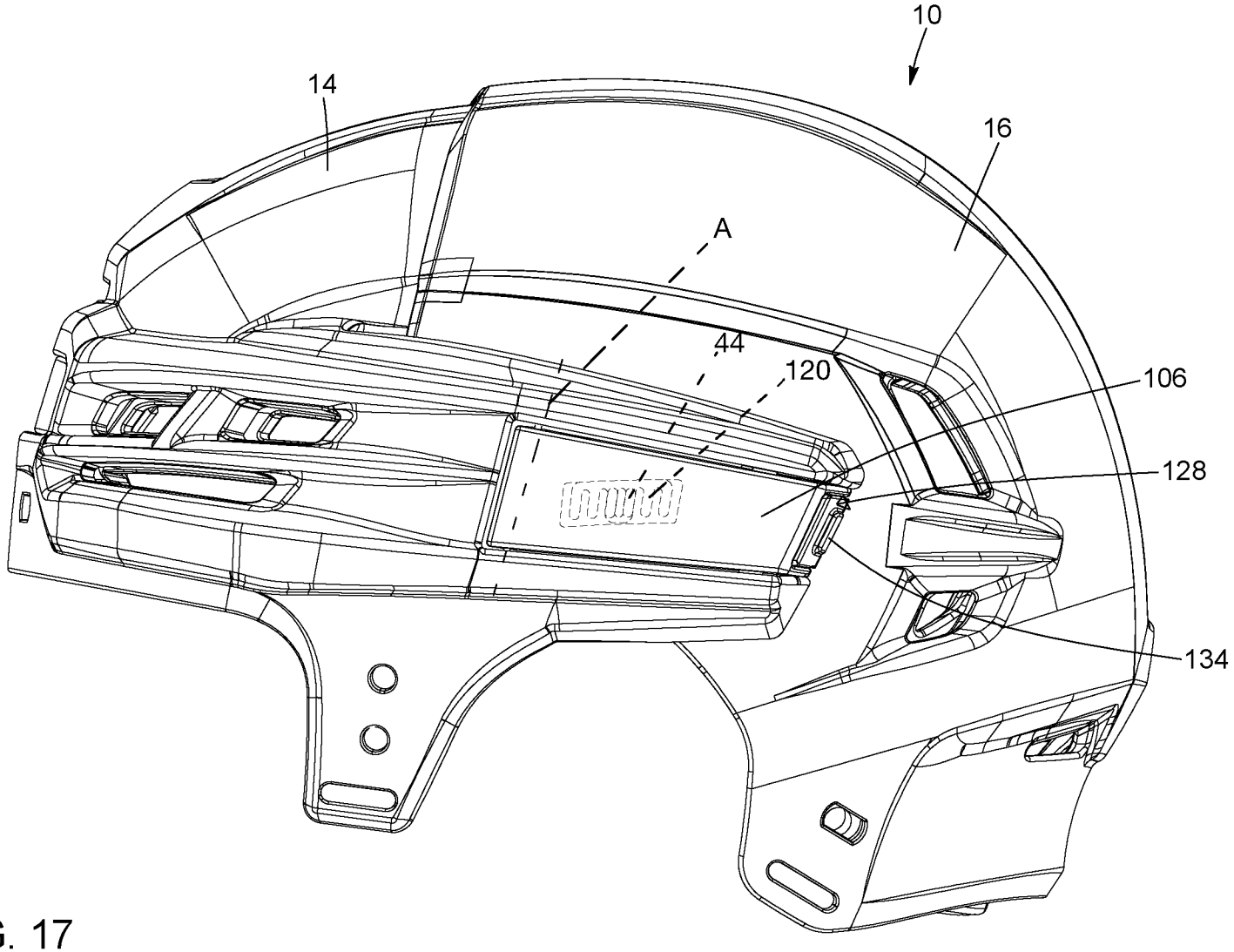
FIG. 17 is a schematic left side view of the helmet of FIG. 3 in a first configuration.
Figure 18:
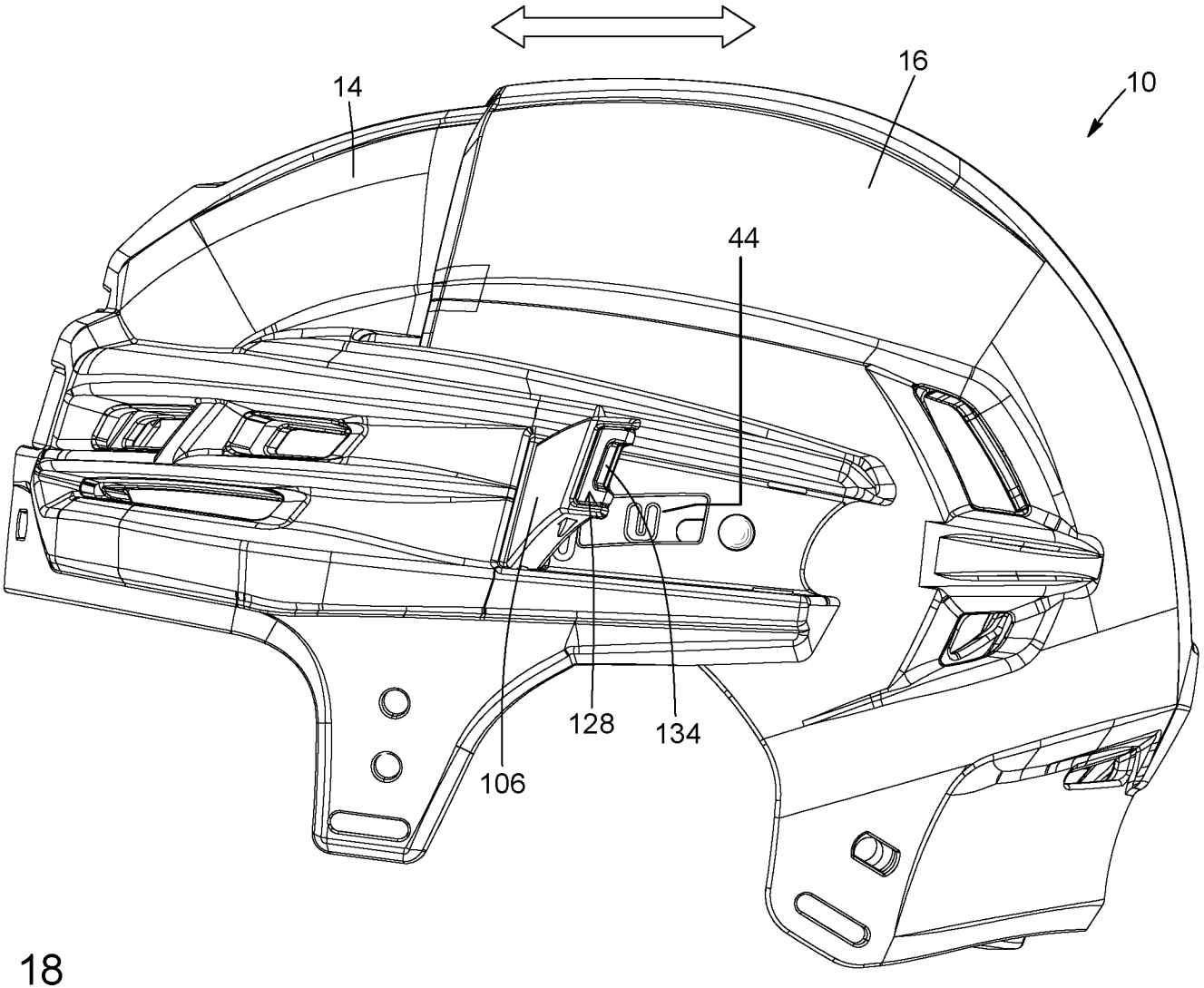
FIG. 18 is a schematic left side view of the helmet of FIG. 3 illustrating an intermediate configuration in which a size of the helmet is adjustable.
Figure 19:
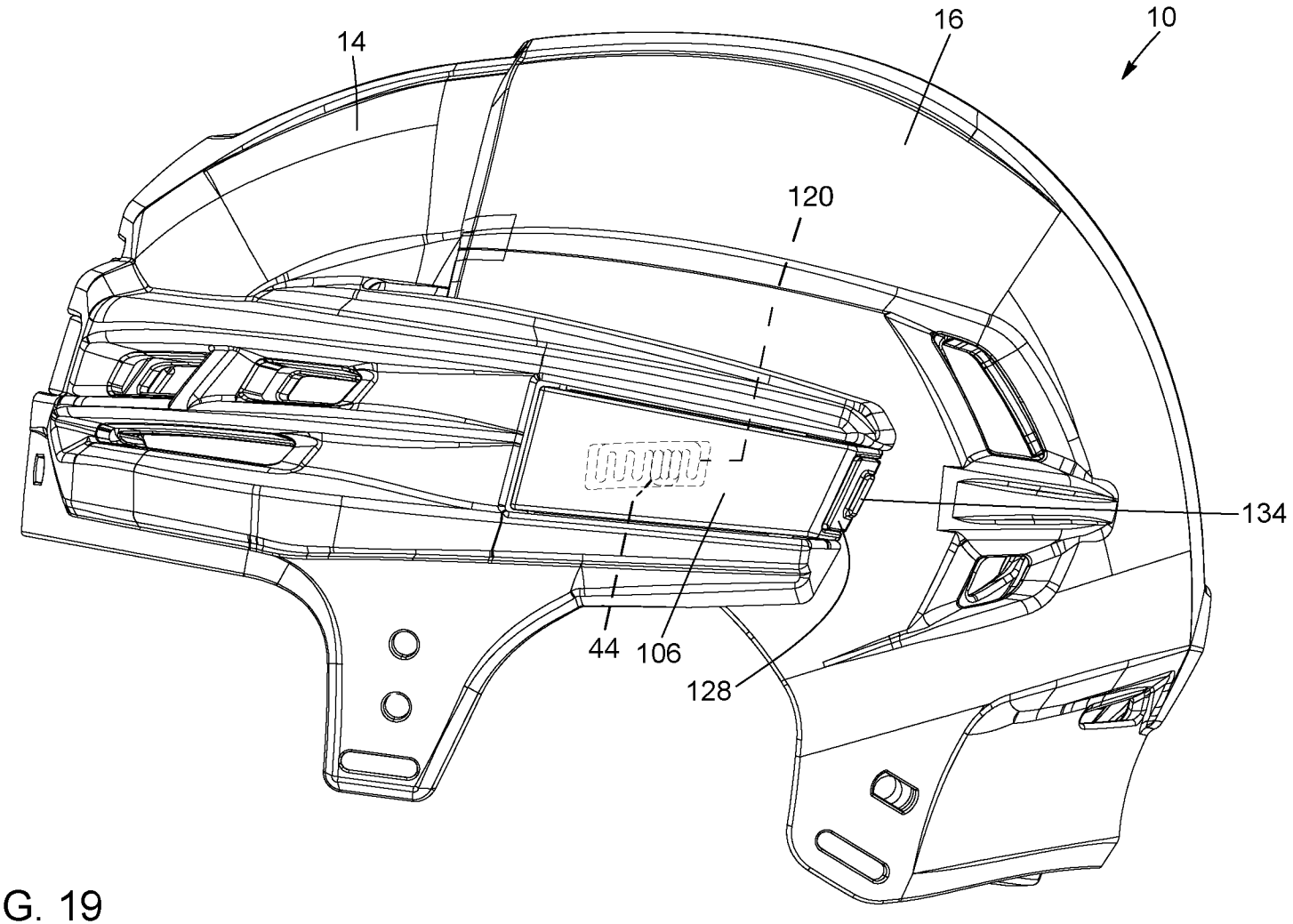
FIG. 19 is a schematic left side view of the helmet of FIG. 3 in a second configuration in which the helmet has a size different than a size in the first configuration of FIG. 17.

Referring now to FIGS. 17 to 19, for adjusting a longitudinal dimension of the helmet 10 relative to the longitudinal axis LA (FIG. 3), the wearer using his or her fingers presses against the left and right actuators 128, 130 in the longitudinal direction relative to the longitudinal axis LA (FIG. 3) until the left and right levers 106, 108 are in their unlocked position. Herein, the pressing of the left and right actuators 128, 130 is done in a direction oriented toward a front of the helmet 10. Once the left and right levers 106, 108 are unlocked, the wearer pivot the left and right levers 106, 108 about respective pivot axes A (FIG. 17), which are oriented at least vertically relative to the vertical axis VA (FIG. 3), to disengage the inner teeth 120 of the left and right levers 106, 108 from the left and right outer teeth 44, 46 of the second shell 16. Then, the wearer moves the front shell 14 relative to the rear shell 16 in the longitudinal direction until the longitudinal dimension of the helmet 10 is suitable for him or her. At which point, the wearer pivots the left and right levers 106, 108 about their respective pivot axes A until another left and right ones of the left and right inner teeth 120 are engaged by the left and right outer teeth 44, 46. The wearer may apply pressure to the left and right actuators 128, 130 to move the upper and lower left and right anchoring projections 138, 140 toward one another to allow the left and right levers 106, 108 to slide back into their respective recesses 66, 68. Upon the anchoring projections 138, 140 are in register with the anchoring apertures 74, 76, 78, 80, the wearer then releases pressure from the left and right actuators 128, 130 thereby allowing the upper and lower left and right anchoring projections 138, 140 to enter the upper and lower left and right anchoring apertures 74, 76, 78, 80 and to lock the left and right levers 106, 108 relative to the front shell 14.

As shown in FIG. 15, the upper and lower left and right anchoring projections 138, 140 have faces 137 oriented toward the front shell 14 when the left and right levers 106, 108 are in the locked position; the faces 137 being angled such that they slope away from the front shell 14 from roots of the projections 138, 140 to tips thereof. Therefore, when pivoting the left and right levers 106, 108 toward the front shell 14, the wearer may not be required to maintain pressure on the left and right actuators 128, 130 and may simply push on the left and right levers 106, toward one another. The sloping shape of the faces 137 allows to create a sliding engagement between the faces 137 and the side portions 30, 32 of the front shell 14 and translates the force exerted by the wearer on the left and right levers 106, 108 in the transversal direction in a vertical force on the anchoring projections 138, 140 pushing them toward one another thereby allowing the penetration of the left and right levers 106, 108 into their respective recesses 66, 68. Once the anchoring projections 138, 140 become in register with the anchoring apertures 74, 76, 78, 80, the anchoring projections 138, 140 snap into the anchoring apertures 74, 76, 78, 80 thanks to the upper and lower flexible arms 139, 141. It will be appreciated that this process may be facilitated by the wearer exerting some pressure on the actuators 128, 130. It will also be appreciated that the front shell 14 may have a portion thereof sloping toward the recesses 66, 68 instead of, or in combination with, the slope faces 137 of the anchoring projections 138, 140.

Hence, the sport helmet 10 may be adjustable to improve its fit on the wearer's head while the adjustment mechanisms (e.g. levers 106, 108) are adapted to remain inoperative as long as the wearer do not actuate or operate them. To this end, in use, the left and right locking actuators 128, 130 prevent pivotable movement of the left and right levers 106, 108 in the locked position and the left and right levers 106, 108 prevent relative movement of the first and second shells 14, 16 in the first position. In the unlocked position, the left and right locking actuators 128, 130 allow pivotable movement the left and right levers 106, 108 into the second position wherein the left and right levers 106, 108 allow relative movement of the first and second shells 14, 16. For instance, in the second position, the left and right engaging parts (inner teeth) of the left and right lever 106, 108 no longer engage the left and right engaging parts (left and right outer teeth 44, 46) of the second shell 16 for allowing movement of the first shell 14 relative to the second shell 16 and for adjusting the fit of the sport helmet 10 over the wearer's head.

The above description of the variants, examples or embodiments should not be interpreted in a limiting manner since other variations, modifications and refinements are possible within the scope of the present disclosure. Accordingly, it should be understood that various features and aspects of the disclosed variants or embodiments can be combined with or substituted for one another in order to form varying modes of the disclosed disclosure. For example, and without limitation, any individual element(s) of the described variants or embodiments may be replaced by alternative elements that provide substantially similar functionality or otherwise provide adequate operation. This includes, for example, presently known alternative elements, such as those that might be currently known to a skilled person in the art, and alternative elements that may be developed in the future, such as those that a skilled person in the art might, upon development, recognize as an alternative. Further, the disclosed variants or embodiments include a plurality of features that are described in concert and that might cooperatively provide a collection of benefits. The present disclosure is not limited to only those embodiments that include all of these features or that provide all of the stated benefits, except to the extent otherwise expressly set forth in the issued claims. Any reference to claim elements in the singular, for example, using the articles "a", "an", or "the", is not to be construed as limiting the element to the singular. Any reference to claim elements as "at least one of X, Y and Z" is meant to include any one of X, Y or Z individually, and any combination of X, Y and Z, including, X, Y, Z; X, Y; X, Z; and Y, Z. The scope of the disclosure is defined in the appended claims and their equivalents.

It is to be understood that the present disclosure is not limited in its application to the details of construction and the arrangement of components set forth in the following description or illustrated in the drawings. The disclosure is capable of other variants or embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional suitable items. Unless specified or limited otherwise, the terms "mounted", "connected", "supported" and "coupled" and variations thereof are used broadly and encompass both direct and indirect mountings, connections, supports and couplings and are thus intended to include direct connections between two members without any other members interposed therebetween and indirect connections between members in which one or more other members are interposed therebetween. Further, "connected" and "coupled" are not restricted to physical or mechanical connections or couplings. Additionally, the words "lower", "upper", "upward", "down", "toward" and "downward" designate directions in the drawings to which reference is made. Similarly, the words "left", "right", "front" and "rear" designate locations or positions in the drawings to which reference is made. The terminology includes the words specifically mentioned above, derivatives thereof, and words or similar import.

What is claimed is:

1. A sport helmet for receiving a head of a wearer, comprising:

an outer shell including a first shell and a second shell movable relative to the first shell; levers hingedly connected to the first shell on left and right sides of the sport helmet for adjustably securing the first and second shells together, the levers of the first shell including first members engageable to second members of the second shell, the first and second members defining at least two attachment points each corresponding to a respective one of at least two sizes of the sport helmet, the levers pivotable between an engaged position and a disengaged position, wherein in the engaged position the first shell is secured to the second shell via cooperating engagement of the first members with the second members at a corresponding one of the at least two attachment points, and wherein in the disengaged position the first members are disengaged from the second members such that the first shell is slidably movable relative to the second shell to adjust a size of the sport helmet; and finger-engageable locking actuators for selectively allowing movement of the levers from the engaged position to the disengaged position, the finger-engageable locking actuators mounted to one of the outer shell and the levers, each one of the finger-engageable locking actuators having a body; the body including at least one anchoring projection protruding away from the body, the anchoring projection displaceable between an extended position and a retracted position receivable within anchoring apertures, the finger-engageable locking actuators movable between a locked position, wherein the anchoring projections are in the extended position and received within corresponding anchoring apertures and an unlocked position, wherein the anchoring projections are in the retracted position, the anchoring apertures defined by another the one of the outer shell and the levers, wherein in the locked position movements of the levers relative to the first shell are limited by the anchoring projections that are received within the anchoring apertures, and wherein in the unlocked position the anchoring projections are disengaged from the anchoring apertures such that the levers are pivotable between the engaged position and the disengaged position.

2. The sport helmet of claim 1, wherein, each of the left and right sides, the first shell is attached to the second shell via at least two connectors received through at least two apertures defined through the first shell and through at least two longitudinal slots defined through the second shell, the at least two connectors slidable within the at least two longitudinal slots.

3. The sport helmet of claim 1, wherein the first shell defines left and right openings, the second members of the second shell extending through the left and right openings.

4. The sport helmet of claim 1, wherein the first members of the levers are left and right sets of inner teeth protruding from lateral walls of the levers and oriented toward the first shell and wherein the second members are left and right outer teeth each protruding away the second shell, teeth of the left and right sets of inner teeth engageable with the left and right outer teeth to limit movement of the first shell relative to the second shell.

5. The sport helmet of claim 4, wherein the left and right outer teeth define cavities sized to removably receive therein left and right selected ones of the teeth of the left and right sets of inner teeth.

6. The sport helmet of claim 1, wherein each of the levers is received within a respective one of recesses defined by the first shell on the left and right sides of the sport helmet, each of the recesses partially enclosed between upper and lower walls of the first shell, the levers having top and bottom walls facing the upper and lower walls of the first shell upon the levers in the engaged position.

7. The sport helmet of claim 6, wherein the anchoring projections include, for each of the levers, at least one anchoring projection extending from one or both of the top and bottom walls of the levers and wherein the anchoring apertures include, for each of the two recesses, at least one anchoring aperture defined through one or both of the upper and lower walls of the first shell.

8. The sport helmet of claim 7, wherein, for each of the levers, the at least one anchoring projection includes two anchoring projections each extending from a respective one of the top and bottom walls and receivable with a respective one of two anchoring apertures each defined through a respective one of the upper and lower walls of the first shell.

9. The sport helmet of claim 1, wherein the finger-engageable locking actuators are partially received within the levers and movable with the levers between the engaged position and the disengaged position.

10. The sport helmet of claim 9, wherein each of the finger-engageable locking actuators is secured to a respective one of the anchoring projections via a flexible arm, the levers defining notches, the flexible arms abuttable against the notches and bendable upon contact with the notches thereby moving the anchoring projections out of the anchoring apertures upon the finger-engageable locking actuators moved from their locked position to their unlocked position.

11. The sport helmet of claim 10, wherein each of the finger-engageable locking actuators includes two flexible arms each having a respective one of the anchoring projections at distal ends thereof.

12. The sport helmet of claim 1, wherein the finger-engageable locking actuators are movable in a direction perpendicular to pivot axes of the levers.

13. The sport helmet of claim 1, wherein the first shell is a front shell and the second shell is a rear shell of the sport helmet.

14. A sport helmet for receiving a head of a wearer, comprising:

an outer shell including a first shell and a second shell movable relative to one another to adjust a size of the sport helmet, the first shell including two side portions protruding away from a remainder of the first shell, the two side portions at least partially overlapping the second shell and ending at distal ends, the two side portions defining recesses each including an upper wall, a lower wall, and a side wall extending from the upper wall to the lower wall;

an adjustment mechanism operable to select a size of the sport helmet, the adjustment mechanism including levers on left and right sides of the sport helmet and receivable within the recesses, the levers hingedly connected to the first shell via hinges located opposite the distal ends of the two side portions, each of the levers having a top wall, a bottom wall, and a lateral wall extending from the top wall to the bottom wall, the levers pivotable from an engaged position in which the first shell is secured to the second shell and in which the top walls and the bottom walls at least partially overlap the upper walls and the lower walls of the recesses and a disengaged position in which the first shell is slidably movable relative to the second shell to adjust the size of the sport helmet; and finger-engageable locking actuators located between the top walls and the bottom walls of the levers and proximate the distal ends of the side portions, the finger-engageable locking actuators movable between a locked position and an unlocked position, the finger-engageable locking actuators including anchoring projections protruding outwardly from the levers and received within anchoring apertures in the outer shell when in the locked position, and in the unlocked position the finger-engageable locking actuators allowing movement of the levers from the engaged position to the disengaged position.

15. The sport helmet of claim 14, wherein the recesses are open at the distal end of the side portions of the first shell.

16. The sport helmet of claim 14, wherein the finger-engageable locking actuators are attached to the levers and slidably movable within lever recesses of the levers.

17. The sport helmet of claim 14, wherein, for each of the left and right sides, the first shell is attached to the second shell via at least two connectors received through at least two apertures defined through the first shell and through at least two slots defined through the second shell, the at least two connectors slidable within the at least two slots.

18. The sport helmet of claim 14, wherein the levers define first members engageable to second members defined by the second shell.

19. The sport helmet of claim 18, wherein the first members of the levers are left and right sets of inner teeth and oriented toward the first shell and wherein the second members are left and right outer teeth each protruding away the second shell, teeth of the left and right sets of inner teeth engageable with the left and right outer teeth.

20. The sport helmet of claim 19, wherein the left and right outer teeth define cavities sized to removably receive left and right selected ones of the teeth of the left and right sets of inner teeth.

21. The sport helmet of claim 14, wherein the finger-engageable locking actuators are engaged to anchoring projections received within anchoring apertures, the finger-engageable locking actuators movable from a locked position in which movements of the levers are limited via the anchoring projections received within the anchoring apertures to an unlocked position in which the anchoring projections are disengaged from the anchoring apertures and in which the levers are pivotable from the engaged position to the disengaged position.

22. The sport helmet of claim 21, wherein the anchoring projections include, for each of the levers, at least one anchoring projection extending from one or both of the top and bottom walls of the levers and wherein the anchoring apertures include, for each of the two recesses, at least one anchoring aperture defined through one or both of the upper and lower walls of the first shell.

23. The sport helmet of claim 22, wherein, for each of the levers, the at least one anchoring projection includes two anchoring projections each extending from a respective one of the top and bottom walls and receivable with a respective one of two anchoring apertures each defined through a respective one of the upper and lower walls of the first shell.

24. The sport helmet of claim 23, wherein each of the finger-engageable locking actuators is secured to a respective one of the anchoring projections via a flexible arm, the levers defining notches, the flexible arms abuttable against the notches and bendable upon contact with the notches thereby moving the anchoring projections out of the anchoring apertures upon the finger-engageable locking actuators moved from the locked position to the unlocked position.

25. The sport helmet of claim 24, wherein each of the finger-engageable locking actuators includes two flexible arms each having a respective one of the anchoring projections at distal ends thereof.

26. The sport helmet of claim 14, wherein the finger-engageable locking actuators are movable in a direction perpendicular to pivot axes of the levers.

27. The sport helmet of claim 14, wherein the first shell is a front shell and the second shell is a rear shell of the sport helmet.

* * * * *